US011807503B2

(12) United States Patent
Helmens et al.

(10) Patent No.: US 11,807,503 B2
(45) Date of Patent: Nov. 7, 2023

(54) CRANE, METHOD FOR ASSEMBLING A CRANE AND METHOD FOR DISASSEMBLING A CRANE

(71) Applicant: Mammoet Holding B.V., Utrecht (NL)

(72) Inventors: Wessel Helmens, Stolwijk (NL); Nicholaas Lamphen, Vianen (NL); Anton Adrian Joachim Van Den Broek, Rijen (NL)

(73) Assignee: MAMMOET HOLDING B.V., Utrecht (NL)

( * ) Notice: Subject to any disclaimer, the term of this patent is extended or adjusted under 35 U.S.C. 154(b) by 160 days.

(21) Appl. No.: 17/259,695

(22) PCT Filed: Jul. 19, 2019

(86) PCT No.: PCT/NL2019/050462
§ 371 (c)(1),
(2) Date: Jan. 12, 2021

(87) PCT Pub. No.: WO2020/022881
PCT Pub. Date: Jan. 30, 2020

(65) Prior Publication Data

US 2021/0316971 A1 Oct. 14, 2021

(30) Foreign Application Priority Data

Jul. 24, 2018 (NL) ..... 2021383
Apr. 9, 2019 (NL) ..... 2022911

(51) Int. Cl.
*B66C 23/36* (2006.01)
*B66C 23/34* (2006.01)
(Continued)

(52) U.S. Cl.
CPC ..... *B66C 23/365* (2013.01); *B66C 23/344* (2013.01); *B66C 23/346* (2013.01);
(Continued)

(58) Field of Classification Search
CPC ..... B66C 23/365; B66C 23/34; B66C 23/344; B66C 23/346; B66C 23/348; B66C 23/42; B66C 23/70; B66C 2700/0371
(Continued)

(56) References Cited

U.S. PATENT DOCUMENTS 3,185,265 A 5/1965 White
8,646,240 B1 * 2/2014 Patrick et al. ..... E21B 19/00 52/651.05
8,935,901 B2 * 1/2015 Petrello et al. ..... E21B 15/00 52/745.17

FOREIGN PATENT DOCUMENTS

DE 102012019248 A1 * 4/2014 ..... B66C 23/26
DE 102015016279 A1 * 6/2016 ..... B66C 23/32
(Continued)

OTHER PUBLICATIONS

Search Report issued in counterpart Netherlands Application No. 2021383, dated Apr. 17, 2019.
International Search Report and Written Opinion issued in counterpart International Application No. PCT/NL2018/050578, dated Jan. 3, 2019.
(Continued)

*Primary Examiner* — Michael R Mansen
*Assistant Examiner* — Henrix Soto
(74) *Attorney, Agent, or Firm* — Cabello Hall Zinda, PLLC

(57) ABSTRACT

The invention pertains to a crane, a method for assembling a crane and a method for disassembling a crane. The crane comprises: a first mast which is tiltable relative to the crane base around a first mast pivot axis into an inclined mast operating position; and a receiving device, which is adapted to receive the mast section of the first mast, which receiving device has a receiving device central axis parallel to the central mast axis, and a mast section guide which is adapted to guide movement of the mast section relative to the receiving device in the direction of the receiving device central axis, wherein the receiving device is connected to the
(Continued)

crane base and the first mast is tiltable relative to the crane base around the first mast pivot axis.

29 Claims, 13 Drawing Sheets

(51) Int. Cl.
*B66C 23/42* (2006.01)
*B66C 23/70* (2006.01)

(52) U.S. Cl.
CPC ..... *B66C 23/42* (2013.01); *B66C 23/70* (2013.01); *B66C 2700/0371* (2013.01)

(58) Field of Classification Search
USPC ..... 212/177
See application file for complete search history.

(56) References Cited

FOREIGN PATENT DOCUMENTS

| | | | | | |
|---|---|---|---|---|---|
| EP | 0516938 | B1 * | 9/1994 | ..... | B66C 23/32 |
| EP | 2695844 | A1 | 2/2014 | | |
| EP | 3301064 | A1 | 9/2017 | | |
| EP | 3301064 | A1 * | 4/2018 | ..... | B66C 23/70 |
| JP | S61127186 | A | 6/1986 | | |
| NL | 6806515 | A | 11/1968 | | |
| WO | 2014048516 | A1 | 4/2014 | | |
| WO | WO2016133389 | A2 * | 8/2016 | ..... | B66C 23/70 |
| WO | 2018052283 | A1 | 3/2018 | | |
| WO | 2018052283 | A9 | 3/2018 | | |

OTHER PUBLICATIONS

Office Action in counterpart JP Appl. 2021-528322 dated Jul. 11, 2023, 20-pgs.

* cited by examiner

CRANE, METHOD FOR ASSEMBLING A CRANE AND METHOD FOR DISASSEMBLING A CRANE

FIELD OF THE DISCLOSURE

The invention pertains to the field of hoisting cranes and hoisting devices, in particular large cranes of modular design wherein the crane is transported in disassembled condition to a site where a hoisting job is to be performed and then assembled.

BACKGROUND OF THE DISCLOSURE

In the field, large lattice boom cranes are used which are assembled on the site at which they are to be operated. Usually, the main boom and/or the back mast of the crane are assembled whilst lying on the ground, and then hoisted and/or pulled up into their operating position. A quite common problem is that limited space is available at the site to build up the crane, e.g., when a new reactor vessel is to be installed at an existing petrochemical plant.

Several solutions to this problem have been proposed.

For example, EP3301064 describes an apparatus for lifting heavy loads. In this apparatus, a ground-standing erection facility is provided, which allows to build up the masts of a crane in a vertical direction instead of lying on the ground (i.e., in horizontal direction). EP3301064 requires a special ground-standing erection facility with a base on which an assembly frame is mounted, which forms an essential part of said invention.

SUMMARY OF THE DISCLOSURE

It is the object of the invention to provide a crane which is suitable for efficient assembly and disassembly at a site where limited space is available. Furthermore, the object of the invention is to provide a practical method for assembling and for disassembling such a crane.

The object of the invention is obtained by a crane, which comprises: —a crane base; —a first mast having a central mast axis, wherein the first mast comprises a mast section, and the first mast is tiltable relative to the crane base around a first mast pivot axis within a range of angular positions, which range of angular positions includes a mast construction position and an inclined mast operating position, wherein the first mast pivot axis extends perpendicular to the central mast axis; —a receiving device or receiver, which is adapted to receive the mast section of the first mast, which receiving device has a receiving device or receiver central axis which is perpendicular to the first mast pivot axis and parallel to the central mast axis, and a mast section guide which is adapted to guide movement of the mast section relative to the receiving device in the direction of the receiving device central axis; —a transfer device or mast section mover, which is adapted to move the mast section of the first mast relative to the receiving device in the direction of the receiving device central axis from a receiving position into a transfer position; —a locking device or lock, which is adapted to releasably lock the position of the mast section of the first mast relative to the receiving device in the transfer position; and—a first mast fixing device or fixture, which is adapted to releasably fix the first mast in the mast construction position.

The crane according to the invention comprises a crane base. The crane base can for example be the chassis of a crawler crane, and/or a foot assembly of e.g. a ringer crane.

The crane base may be a conventional crane base. The crane base can e.g. be a pedestal, e.g. comprising three, four, six or eight outriggers. The crane base is for example arranged on a support surface of a working area. The support surface is for example a part of the ground which is provided with loose steel plates for better consistency. The crane according to the invention may e.g. be a derrick crane.

The crane according to the invention has a first mast which comprises a mast section. Optionally, the first mast comprises multiple mast sections.

The first mast has a central axis, which extends in the longitudinal direction of the first mast. The first mast is tiltable relative to the crane base around a first mast pivot axis within a range of angular positions. The first mast pivot axis extends perpendicular to the central mast axis. The first mast pivot axis extends for example in horizontal direction.

The range of angular positions includes a mast construction position and an inclined mast operating position. The mast construction position is the angular position of the first mast when the first mast is assembled. The mast operating position is the angular position which the first mast has or can have when a load is lifted by the crane during a hoisting operation.

In the inclined mast operating position, the central axis of the first mast extends in a direction which is at angle other than 0° and also other than 90° from the vertical direction. For example, in the inclined mast operating position, the central axis of the first mast extends under and angle between 5° and 75° relative to the vertical direction. The crane according to the invention is suitable for being operated with the first mast in an inclined mast operating position. In exceptional cases, the mast operating position may be vertical, e.g. during a part of the hoisting job, but still the first mast has an inclined mast operating position as long as the crane is suitable for being operated with the first mast in an inclined mast operating position. Optionally the range of angular positions includes multiple inclined mast operating positions in which the central axis of the first mast extends in different directions which are at angle other than 0° and also other than 90° from the vertical direction. That is, the crane may be suitable for being operated with the first mast being in one of said multiple inclined mast operating position This inclined mast operating position makes the crane according to the invention different from e.g. a tower crane or revolving tower crane, in which the upright mast is always at a vertical position during operation of the crane. Although it is also known to assemble the upright mast of tower cranes vertically, e.g. from U.S. Pat. No. 3,491,897 and WO2014048516A1, this is very different from the present invention. The upright mast in tower cranes remains substantially vertical at all times during operation. The systems used to erect the upright mast remain a part of the upright mast once erected, by being arranged between the crane base and the lowest mast section. They do not allow the upright mast to pivot relative to the crane base, i.e. there is no inclined mast operating position. The forces that occur in the first mast of the crane according to the invention are very different from the forces in the upright mast of a tower crane, exactly because the upright mast of a tower crane remains vertical. The systems used to erect the upright mast in tower cranes are not suitable for bearing the loads of an inclined mast or even allowing the mast to tilt to an inclined (mast operating) position.

Moreover, the tower cranes do not achieve the envisaged advantage of the present invention. Although the upright mast may be erected vertically, there is also a horizontal mast which extends from the top of the upright mast. The horizontal mast is assembled horizontally on the floor before it is brought into a functional position for hoisting. Thus, there is a substantial amount of space required to assemble a tower crane, which is exactly what can be avoided with the present invention.

The crane according to the invention further comprises a receiving device or receiver, which is adapted to receive the mast section of the first mast. During the assembly of the first mast, the receiving device receives a mast section which is to be added to the first mast. In embodiments in which the first mast comprises multiple mast section, the receiving device successively receives multiple mast sections.

The receiving device has a receiving device or receiver central axis which is perpendicular to the first mast pivot axis and parallel to the central mast axis.

The receiving device further comprises a mast section guide which is adapted to guide movement of the mast section relative to the receiving device in the direction of the receiving device central axis. For example, the mast section guide extends in a direction which is parallel to the central mast axis and to the receiving device central axis.

The crane according to the invention further comprises a transfer device or mast section mover. The transfer device is adapted to move the mast section of the first mast relative to the receiving device in the direction of the receiving device central axis from a receiving position into a transfer position.

The receiving position of the mast section of the first mast is the position this mast section has relative to the receiving device when it is arranged in the receiving device prior to but ready for transfer to the transfer position. In general, the mast section is engaged by the mast section guide (either directly or indirectly) in the receiving position.

The transfer position of the mast section of the first mast is the position this mast section has when the receiving device is ready to receive a subsequent mast section of the first mast in the receiving position.

The receiving position and the transfer position are offset from each other in the direction of the receiving device central axis.

The transfer device is for example provided with one or more hydraulic cylinders and/or one or more cables to bring the mast section from the receiving position to the transfer position.

Optionally, the transfer device is mounted onto the receiving device. Alternatively, the transfer device is for example mounted on the crane base.

Optionally, the transfer device engages the mast section, either directly or indirectly.

The crane according to the invention further comprises a locking device or lock, which is adapted to releasably lock the position of the mast section of the first mast relative to the receiver frame in the transfer position. The locking device therewith prevents that a mast section slides back from the transfer position into the receiving position. When the locking device locks the mast section in the transfer position, a subsequent mast section can be safely placed in the receiving position in the receiving device.

For example, the locking device may comprise moveable pins which block movement of the mast section from the transfer position towards the receiving position. The pins may for example be hydraulically or pneumatically operated.

Optionally, the locking device is mounted onto the receiver frame. Alternatively, the locking device is for example mounted on the crane base.

The locking device may for example release the mast section from the transfer position when a subsequent mast section pushes the mast section further in a direction parallel to the receiving device central axis during the further assembly of the first mast.

The crane according to the invention further comprises a first mast fixing device or fixture, which is adapted to releasably fix the first mast in the mast construction position. During the assembly and optionally also during disassembly of the first mast, the first mast fixing device holds the first mast in the mast construction position. When the first mast is to be tilted into the inclined mast operating position, the first mast fixing device releases the first mast to allow the tilting of the first mast.

In an embodiment, the crane is a high-capacity crane, e.g. a high-capacity mobile crane. For example, high capacity may be interpreted as being able to hoist a load of at least 200 ton, preferably at least 300 ton, optionally at least 500 ton. These kinds of cranes are often required on specific hoisting locations where there is only limited space to assemble the crane, e.g. on petrochemical or other industrial plants, or in densely built areas. Advantageously the crane according to the invention can be assembled on such locations. It is noted that tower cranes are not suitable for lifting such loads.

In an embodiment, the crane further comprises a second mast. The second mast enables the crane to hoist heavy loads, e.g., when the crane is a high-capacity crane.

For example, the first mast is a main boom and the second mast is a back mast. Alternatively, the first mast is a back mast, and the second mast is the main boom.

Optionally, the second mast has a central second mast axis, and is tiltable relative to the crane base around a second mast pivot axis which extends perpendicular to the central second mast axis. Optionally, the second mast is tiltable relative to the crane base around the second mast pivot axis within a range of angular positions, which range includes a second mast construction position and an inclined second mast operating position.

Optionally, the second mast comprises a mast section. Optionally, the second mast comprises multiple mast sections.

Optionally, the second mast pivot axis and the first mast pivot axis are parallel to each other.

Optionally, the second mast pivot axis and the first mast pivot axis are movable relative to each other in a direction towards and away from each other.

Optionally, the first mast pivot axis and the second mast pivot axis are positioned close to each other, e.g., the distance between the first mast pivot axis and the second mast pivot axis is less than 5 meters, optionally less than 3 meters. This allows a small footprint of the crane, which is advantageous when the crane has to be used at hoisting locations where there is little space for the crane.

Optionally, the second mast is configured to be connected to a ballast.

In an embodiment, the crane comprises a second mast having a central mast axis, wherein the second mast comprises a mast section, and the second mast is tiltable relative to the crane base around a second mast pivot axis within a range of angular positions, which range of angular positions includes a mast construction position and an inclined mast operating position, wherein the second mast pivot axis extends perpendicular to the central mast axis, In this embodiment, the crane further comprises a second mast receiving device or receiver, which is adapted to receive a mast section of the second mast. The second mast receiving device has a second mast receiving device central axis which is perpendicular to the second mast pivot axis and parallel to the central mast axis of the second mast, and a second mast section guide which is adapted to guide movement of the mast section of the second mast relative to the second mast receiving device in the direction of the second mast receiving device central axis.

In this embodiment, the crane further comprises a second mast transfer device or mast section mover, which is adapted to move the mast section of the second mast relative to the second mast receiving device in the direction of the second mast receiving device central axis from a receiving position into a transfer position.

In this embodiment, the crane further comprises a locking device or lock, which is adapted to releasably lock the position of the mast section of the second mast relative to the second mast receiving device in the transfer position.

In this embodiment, the crane further comprises a second mast fixing device or fixture, which is adapted to releasably fix the second mast in the mast construction position.

In this embodiment, the second mast receiving device is connected to the crane base and tiltable along with the second mast relative to the crane base around the second mast pivot axis.

Optionally, the second mast fixing device is adapted to releasably fix the second mast of the crane in the mast construction position by engaging the second mast receiving device and/or the second mast.

Optionally, the second mast fixing device is adapted to function as a boom stop when the second mast is in the inclined operating position.

In an embodiment, the crane base is pivotable about a substantially vertical crane base pivot axis. Optionally the vertical crane base pivot axis coincides with a central axis of the crane base.

In an embodiment, the first mast is pivotable relative to the crane base about a substantially vertical pivot axis. Preferably, when the crane comprises the second mast, also the second mast is pivotable relative to the crane base about said vertical pivot axis. Optionally the vertical pivot axis coincides with a central axis of the crane base.

Advantageously the embodiments above allow to pivot the crane base and therewith the first mast and, when present, the second mast. For example, after a load is lifted, the crane base can be pivoted to then release the load on another location.

In an embodiment wherein the second mast has a central second mast axis, and is tiltable relative to the crane base around a second mast pivot axis which extends perpendicular to the central second mast axis, and the second mast is also configured to be connected to a ballast, the crane is configured to move the ballast closer and further away from the crane base. Optionally, the second mast is configured to move the ballast. Optionally, the crane is configured to move the ballast between two hoisting operations and/or during a hoisting operation, e.g., after picking up a load and before releasing said load.

In this embodiment, the ballast can be moved closer and further away from the crane base. This allows to decrease the physical space occupied by the crane when desired. For example, during a first hoisting operation the ballast may be arranged relatively far from the crane base. If the crane needs to be rotated about its crane base, the ballast may be arranged closer to the crane base. As such, less space is required during the rotation, advantageously enabling the crane to maneuver between obstacles. This embodiment may be implemented, for example, in accordance with what is also known under the name "superlift ballast".

For example, the ballast may be moved closer or further from the crane base in a direction substantially parallel to a support surface on which the crane base is arranged. Optionally the distance in vertical direction to the support surface is also changed during such movement of the ballast, for example because the distance between the ballast and an upper end of the second mast remains substantially constant, for example because the ballast is connected to the second mast by a wire or cable.

In an embodiment, an imaginary assembly space can be defined as extending vertically upwards above the crane base and having outer borders in horizontal direction extending vertically upwards from outer borders of the crane base. Thus, in horizontal direction outer borders of the assembly space correspond with the outer borders of the crane base. In this embodiment, the first mast is configured to be completely within said assembly space when the first mast is in the mast construction position. Preferably the first mast is configured to be completely within said assembly space during assembly of the first mast.

In an embodiment, the second mast is configured to be completely within said assembly space when the second mast is in the second mast construction position. Preferably the second mast is configured to be completely within said assembly space during assembly of the second mast.

In an embodiment, the receiving device and/or the transfer device and/or the locking device are configured to be completely within said assembly space when the first mast is in the mast construction position and/or during assembly of the first mast.

In an embodiment, the crane is completely within the assembly space during assembly of the crane.

In these embodiments, the space in horizontal direction required to assemble the first mast, and/or second mast, and/or the complete crane, does not extend beyond the crane base. Since this amount of space in horizontal direction is already required for the crane base itself, the first mast, and/or second mast, and/or the complete crane, are assembled in a space that it as small as possible. Of course, mast sections of the first mast and/or the second mast may be provided from outside of the assembly space before they are arranged in the receiving device. For example, said mast section may be arranged on the floor or support surface adjacent to the base frame.

In an embodiment, the first mast may be tilted in a first direction in the inclined mast operating position relative to the mast construction position, wherein the crane further comprises at least one winch and/or sheave for a hoisting cable. Said winch and/or sheave are arranged at a first side of the first mast which corresponds with the first direction. The hoisting cable may e.g. be part of a hoisting system which may e.g. be arranged on a mast section, e.g. a top mast section. For example, when the first direction is to the left, the first side of the first mast is the left side of the first mast. For example, when the first direction is to the right, the first side of the first mast is the right side of the first mast.

Optionally said winch and/or sheave are arranged on the receiving device.

Optionally when the crane comprises a second mast, the first direction is away from the second mast.

Advantageously the assembly of the crane can be done with minimal obstruction of said winch and/or sheave in this embodiment. Components such as cables and/or guy wires and/or boom stops must usually be attached to the first mast at a second side of the first mast opposite of the first side. In particular when the crane comprises a second mast, which is arranged on the second side, cables and/or guy wires may be provided between the first and second mast.

In an embodiment, the receiving device is connected to the crane base and optionally tiltable along with the first mast relative to the crane base around the first mast pivot axis.

So, the receiving device moves along with the first mast when the first mast is tilted into the inclined mast operating position. The receiving device central axis remains parallel to the central mast axis. Both the receiving device and the first mast tilt about the same pivot axis.

The mast section guide forms part of the receiving device and therewith also tilts along with the first mast. This way, the mast section guide does not have to be disconnected from and moved out of the way of the first mast before tilting the first mast into the inclined mast operating position. This allows a simpler and smaller construction, and also save time and effort during assembly and disassembly of the crane.

In an embodiment, the first mast is tiltable relative to the crane base around the first mast pivot axis without the receiving device. In other words, the first mast is tiltable relative to the receiving device. Optionally, the receiving device is configured to remain substantially upright when the first mast is tilted.

So, the receiving device does not move along with the first mast when the first mast is tilted into the inclined mast operating position. The receiving device central axis does not remain parallel to the central mast axis.

In an embodiment, the receiving device is configured to be removable from the crane after assembly of the first mast, for example while the first mast is in the mast construction position or in the inclined mast operating position. Optionally, the receiving device is further configured to be arranged on a second position on the crane base for assembly of a second mast. Optionally, the receiving device is configured to be arranged on another crane base for assembly of another first or second mast.

Advantageously this embodiment allows to use a single receiving device or receiver for assembling multiple masts.

In an embodiment, the first mast comprises a lower mast section which is connected to the crane base and tiltable relative to the crane base around the first mast pivot axis. Optionally the lower mast section is tapered in the direction of the crane base, i.e. a cross-section of the lower mast section closer to the crane base is smaller than a cross-section of the lower mast section further away from the crane base.

In this embodiment, the mechanical loads that are exerted on the first mast during operation of the crane are borne by the first mast, and not or only to a limited extent by the receiving device. This allows a relatively light design of the receiving device, including the mast section guide.

In an alternative embodiment, the lowest mast section of the first mast is not directly connected to the crane base, but connected to the crane base via the receiving device. In this embodiment, the lowest mast section is for example fixed in the transfer position.

In an embodiment, the central mast axis of the first mast extends vertically when the first mast is in the construction position.

"Vertically" means exactly vertical or a small deviation from exactly vertical, e.g. a deviation of 5° maximum.

Advantages of this embodiment are that the first mast is not or hardly subjected to bending forces during assembly and disassembly of the first mast, and that a relatively small space at the hoisting site is sufficient to assemble the crane.

In an alternative embodiment, the central mast axis of the first mast extends at an angle relative to the vertical, which angle is not 0° and also not 90°, when the first mast is in the construction position.

In an embodiment, a mast section of the first mast is provided with at least a part of a hoisting system. For example, a mast section can be provided with at least a part of the hoisting system, e.g., with sheaves for a hoisting cable and/or a hoisting block and/or hoisting hook or other connector. For example, the top mast section or an intermediate mast section may be provided with at a least a part of the hoisting system. The hoisting system may be used for hoisting loads during the operation of the crane. Alternatively or in addition, the hoisting system may comprise a cable which in the assembled crane form a guy wire between the first mast and a second mast.

This is advantageous because the hoisting system can also be used to assemble a second mast of the crane.

In an embodiment, the first mast comprises multiple mast sections. For example, the first mast may comprise a top mast section, multiple intermediate mast sections and optionally a lower mast section.

The top mast section may be provided with at least a part of a hoisting system. The lower mast section may be tiltably connected to the crane base.

In this embodiment, the receiving device is optionally adapted to successively receive multiple mast sections.

In an embodiment, the first mast comprises a tilting member which allows an upper portion of the first mast to tilt away from the central mast axis of the first mast.

In embodiments in which the crane comprises a second mast, optionally the second mast comprises a tilting member which allows an upper portion of the second mast to tilt away from the central mast axis of the second mast. Optionally, the first mast or the second mast is provided with a tilting member. Alternatively, both the first mast and the second mast are provided with a tilting member.

For example, a tilting member as described in NL 2019511 could be used. NL 2019511 is incorporated herein by reference.

This allows the use of the crane in confined areas, where limited space is available for the crane and/or for operating the crane.

Optionally, the tilting member may be provided with at a least a part of a hoisting system. This is for example and additional hoisting system which can be used for assembly and/or disassembly of a second mast of the crane. Alternatively or in addition, the tilting member may be provided with a cable system which in the assembled crane forms a guy wire between the first mast and the second mast, and which optionally can also be used for assembly and/or disassembly of a second mast of the crane.

In an embodiment, the first mast fixing device is adapted to releasably fix the first mast in the mast construction position by engaging the receiving device and/or the first mast.

In an embodiment, the first mast fixing device is adapted to function as a boom stop when the first mast is in the inclined operating position.

In an embodiment, the crane is provided with a cable system having multiple sheaves, and wherein at least a sheave of the cable system is arranged on the receiving device.

The cable system can for example be part of the hoisting system and/or the rigging of the crane.

In an embodiment, the crane is provided with a winch, which winch is arranged on the receiving device.

The winch can for example be part of the hoisting system and/or the rigging of the crane.

In an embodiment, the crane is provided with a cable system having multiple sheaves, and wherein at a sheave of the cable system is arranged on the crane base.

The cable system can for example be part of the hoisting system and/or the rigging of the crane.

In an embodiment, the crane is provided with a winch, which winch is arranged on the crane base.

The winch can for example be part of the hoisting system and/or the rigging of the crane.

The invention further pertains to a method for assembling a crane, which crane comprises a first mast having a central mast axis, wherein the first mast comprises a mast section, and the first mast is tiltable relative to a crane base around a first mast pivot axis within a range of angular positions, which range includes a mast construction position and an inclined mast operating position, wherein the first mast pivot axis extends perpendicular to the central mast axis, which method comprises the following steps: —connecting a receiving device or receiver which is adapted to receive a mast section of the first mast and which has a receiving device or receiver central axis to a crane base, wherein first mast pivot axis extends perpendicular to the receiving device central axis—fixing the receiving device in a position in which the receiving device central axis is parallel to the central mast axis of the first mast in the mast construction position, —arranging a mast section of a first mast of the crane in the receiving device, —moving the mast section of the first mast relative to the receiving device in the direction of the receiving device central axis from a receiving position into a transfer position, wherein the mast section of the first mast is in an angular position which corresponds to the first mast construction position, —locking the position of the mast section relative to the receiving device in the transfer position to build up the first mast.

The crane which is assembled in accordance with the method according to the invention is a crane which comprises a first mast having a central mast axis, wherein the first mast comprises a mast section, and the first mast is tiltable relative to the crane base around a first mast pivot axis within a range of angular positions, which range includes a mast construction position and an inclined mast operating position, wherein the first mast pivot axis extends perpendicular to the central mast axis.

For example, the crane which is assembled by the method according to the invention is a crane according to the invention, although the method is not limited thereto. Nevertheless, features explained with reference to the crane according to the invention shall be interpreted in the same way with reference to the method according to the invention. Furthermore, features explained with reference to the crane according to the invention may be added to or combined with the method according to the invention, and vice versa.

In the method according to the invention, a receiving device or receiver—which is adapted to receive a mast section of the first mast, and which has a receiving device or receiver central axis—is connected to a crane base. The first mast pivot axis extends perpendicular to the receiving device central axis.

Then, the receiving device is fixed in a position in which the receiving device central axis is parallel to the central mast axis of the first mast in the mast construction position. The first mast is not present or fully present at this stage of the method, but the receiving device is fixed in a position in which the receiving device central axis is parallel to the direction the central mast axis of the first mast will be in when the first mast is in the mast construction position.

Then, a mast section of a first mast of the crane is arranged in the receiving device.

Then, the mast section of the first mast is moved, e.g., by a transfer device or mast section mover, relative to the receiving device in the direction of the receiving device central axis from a receiving position into a transfer position. When a transfer device or mast section mover is used, the transfer device or mast section mover may engage the mast section either directly or indirectly.

The receiving position of the mast section of the first mast is the position this mast section has relative to the receiving device when it is arranged in the receiving device prior to but ready for transfer to the transfer position. In general, the mast section is engaged by the mast section guide (either directly or indirectly) in the receiving position.

The transfer position of the mast section of the first mast is the position this mast section has when the receiving device is ready to receive a subsequent mast section of the first mast in the receiving position. The receiving position and the transfer position are offset from each other in the direction of the receiving device central axis.

When the transfer device moves the mast section from the receiving position to the transfer position, the mast section of the first mast is in an angular position which corresponds to the first mast construction position.

Then, the position of the mast section relative to the receiving device is locked (e.g., by locking means) in the transfer position to build up the first mast. When the mast section is locked in the transfer position, a subsequent mast section can be arranged in the receiving device if this is desired.

Then, the fixing of the receiving device is optionally released.

In an embodiment, the crane which is assembled with the method according to the invention is a high-capacity crane, e.g., a high-capacity mobile crane.

In an embodiment of the method according to the invention, a crane is assembled which comprises a second mast. For example, the first mast is a main boom, and the second mast is a back mast. Alternatively, the first mast is a back mast, and the second mast is the main boom.

Optionally the second mast has a central mast axis, wherein the second mast comprises a mast section, and the second mast is tiltable relative to the crane base around a second mast pivot axis within a range of angular positions, which range of angular positions includes a mast construction position and an inclined mast operating position, wherein the second mast pivot axis extends perpendicular to the central mast axis.

In an embodiment, the method further comprises a step of: releasing the fixing of the receiving device and tilting the first mast around the first mast pivot axis, into an angular position which corresponds to the inclined mast operating position.

In an embodiment, the step of connecting the receiving device to the crane base includes: tiltably connecting the receiving device to the crane base, therewith making the receiving device tiltable relative to the crane base around the first mast pivot axis.

In this embodiment the method optionally further comprises a step of tilting the receiving device and the first mast together around the first mast pivot axis, into the angular position which corresponds to the inclined mast operating position.

In this embodiment the receiving device is tiltable relative to the crane base around the first mast pivot axis.

In an embodiment the method further comprises a step of: tilting the first mast around the first mast pivot axis, into an angular position which corresponds to the inclined mast operating position, wherein the receiving device is remains in an substantially upright position.

In an embodiment of the method according to the invention, a crane is assembled in which at least one mast section of the first mast comprises at least a part of a hoisting system. This part of the hoisting system can then be used to build up the second mast of the crane, which second mast comprises a mast section.

In this embodiment of the invention, a hoisting cable which is connected to the at least a part of the hoisting system of the mast section of the first mast is connected to a mast section of a second mast.

The mast section of the second mast is connected to the crane base (either directly or via one or more mast sections between this particular mast section and the crane base) to build up the second mast and the second mast is made tiltable relative to the crane base around a second mast pivot axis, which is parallel to the first mast pivot axis.

Optionally, in this embodiment of the method according to the invention, the step of connecting a hoisting cable which is connected to the at least part of the hoisting system of the mast section of the first mast to a mast section of a second mast takes place before releasing the fixing of the receiving device and tilting the mast section of the first mast, optionally together with the receiving device, around the first mast pivot axis into an angular position which corresponds to the inclined mast operating position.

Optionally, in this embodiment of the method according to the invention, the method further comprises the step of moving the second mast pivot axis and the first mast pivot axis relative to each other in a direction towards each other.

Optionally, in this embodiment of the method according to the invention, the method further comprises the step of tilting the second mast into an inclined second mast operating position. This takes place for example before the first mast is tilted into the inclined mast operating position, optionally together with the receiving device.

Optionally, this embodiment of the method according to the invention can be carried out as follows: first, the first mast is build up to its desired length by connecting the desired number of mast sections.

Then, the top mast section of the second mast is connected to the hoisting system, e.g. by lowering a hook or connector of the hoisting system and connecting the hook or connector to the top mast section of the second mast.

Then, the top mast section is moved upwards into a position which allows to connect a further mast section to the top mast section of the second mast, in particular to the lower edge of this top mast section. Such a further mast section is then arranged below the top mast section of the second mast and connected to this top mast section of the second mast.

If the desired length of the second mast requires that more further mast sections are added, then the top mast section and further mast section (s) which are connected thereto are lifted higher and further mast sections are added and connected to the mast sections of the second mast which are already hanging from the hook or connector of the hoisting system.

Optionally, the last mast section that is added is the lower mast section of the second mast. This lower mast section is connected to the lowest of the mast sections that are suspended from the hook or connector of the hoisting system and the lower mast section of the second mast is connected to the crane base and made tiltable relative to the crane base around the second mast pivot axis.

In an embodiment of the method according to the invention wherein the crane comprises a second mast, method comprises the following steps: —connecting a second mast receiving device or receiver which is adapted to receive a mast section of the second mast and which has a second mast receiving device or receiver central axis to a crane base, wherein optionally the second mast receiving device is connected tiltably to the crane base, therewith making the second mast receiving device tiltable relative to the crane base around the second mast pivot axis, which second mast pivot axis extends perpendicular to the receiving device central axis, —fixing the second mast receiving device in a position in which the second mast receiving device central axis is parallel to the central mast axis of the second mast in the mast construction position, —arranging a mast section of a second mast of the crane in the second mast receiving device, —moving the mast section of the second mast relative to the second mast receiving device in the direction of the second mast receiving device central axis from a receiving position into a transfer position, wherein the mast section of the second mast is in an angular position which corresponds to the second mast construction position, —locking the position of the mast section relative to the second mast receiving device in the transfer position to build up the second mast, —optionally releasing the fixing of the second mast receiving device and tilting the second mast, optionally together with the second mast receiving device, around the second mast pivot axis into an angular position which corresponds to the inclined mast operating position.

So, the second mast may be built up in the same way as the first mast.

Optionally, in the step of fixing the second mast receiving device in a position in which the second mast receiving device central axis is parallel to the central mast axis of the second mast in the mast construction position, the second mast receiving device is fixed in a position in which the second receiving device central axis extends vertically.

In an alternative embodiment, the central mast axis of the second mast extends at an angle relative to the vertical, which angle is not 0° and also not 90°, when the second mast is in the construction position.

In a variant of this embodiment, the second mast is built up before the first mast is finished. For example, intermediate mast sections are added the first mast and the second mast simultaneously. Alternatively, intermediate mast sections are added to the first mast and the second mast in an alternating way, for example first an intermediate mast section is added to the first mast, then an intermediate mast section is added to the second mast, and then optionally an intermediate mast section is added to the first mast again.

In an embodiment of the method according to the invention, at least one, and preferably each, of the mast sections of the first mast remain within an imaginary assembly space, at least from the moment that said mast section is arranged in the receiving device until the first mast is assembled in the mast construction position. The assembly space can be defined as extending vertically upwards above the crane base and having outer borders in horizontal direction extending vertically upwards from outer borders of the crane base.

Thus, in horizontal direction outer borders of the assembly space correspond with the outer borders of the crane base. In this embodiment, the first mast is configured to be completely within said assembly space during assembly of the first mast and when the first mast is in the mast construction position.

In an embodiment, each of the mast sections of the second mast remain within said assembly space during assembly of the second mast. For example, said mast section may be in the assembly space at least from the moment that said mast section is arranged in the receiving device until the second mast is assembled in the mast construction position. For example, said mast section may be in the assembly space at least from the moment it is connected to the hoisting cable that is part of the hoisting system of the mast section of the first mast until the second mast is assembled in the mast construction position.

In an embodiment, the receiving device and/or the transfer device and/or the locking device remain within said assembly space during assembly of the first mast, e.g., at least from the moment first mast section is arranged in the receiving section until the first mast is arranged in the mast construction position.

In an embodiment, the crane remains completely within the assembly space during assembly of the crane.

In these embodiments, the space in horizontal direction required to assemble the first mast, and/or second mast, and/or the complete crane, does not extend beyond the crane base. Since this amount of space in horizontal direction is already required for the crane base itself, the first mast, and/or second mast, and/or the complete crane, are assembled in a space that it as small as possible. In other words, the crane is assembled above its own footprint. Of course, mast sections of the first mast and/or the second mast may be provided from outside of the assembly space before they are arranged in the receiving device. For example, said mast section may be arranged on the floor adjacent to the base frame.

Optionally, a cross section of the assembly space in the horizontal plane smaller than 50 square meters, preferably smaller than 30 square meters, e.g., smaller 20 square meters.

In an embodiment of the method according to the invention, a first mast is built up which comprises multiple mast sections.

In this embodiment of the method according to the invention, after the step of locking the position of the mast section relative to the receiving device in the transfer position and when applicable before the step of releasing the fixing of the receiving device and tilting the mast section of the first mast optionally together with the receiving device around the first mast pivot axis into an angular position which corresponds to inclined mast operating position, a further mast section of a first mast of the crane is arranged in the receiving device.

This further mast section of the first mast is connected to the mast section of the first mast that is locked in the transfer position. The mast section of the first mast in the transfer position is then unlocked. It comes to rest upon the further mast section.

Then, the further mast section of the first mast is moved relative to the receiving device (e.g., by a transfer device) in the direction of the receiving device central axis from a receiving position into the transfer position. When the transfer device moves the mast section from the receiving position to the transfer position, the mast section of the first mast is in an angular position which corresponds to the first mast construction position. The mast section which was in the transfer position is therewith moved away from the transfer position in a direction that is parallel to the central mast axis to further build up the first mast.

The position of the further mast section is then locked (e.g., by a locking device or lock) relative to the receiving device in the transfer position.

The steps of this embodiment are optionally repeated as often as necessary to obtain the desired length of the first mast.

In a variant of this embodiment, the top mast section is arranged in the transfer position by an external crane. It is then locked into the transfer position such that further mast sections may be added by the receiving device and optionally the transfer device to further build up the first mast. This variant may be advantageous if the top mast section has equipment attached to it (e.g., a part of the hoisting system) which makes it hard, complex or even impossible to be handled by the receiving device.

In another variant, an intermediate mast section is first arranged in the transfer position as explained above. The top mast section is then arranged on top of the intermediate mast section, e.g., by an external crane. Preferably the top mast section is then attached to the intermediate mast section.

In yet another variant, multiple mast sections are assembled together according to the method according to the invention. For example, the multiple mast section may comprise multiple intermediate mast sections, or at least one intermediate mast section and a lower mast section. The top mast section is then arranged on top of the highest intermediate mast section, e.g., by an external crane. Preferably the top mast section is then attached to the intermediate mast section.

In an embodiment of the method according to the invention, a lower mast section is added to the first mast. This lower mast section is connected to the crane base and tiltable relative to the crane base around the first mast pivot axis. In this embodiment, the mechanical loads that are exerted on the first mast during operation of the crane are borne by the first mast, and not or only to a limited extent by the receiving device. This allows a relatively light design of the receiving device, including the mast section guide.

In this embodiment of the method according to the invention, after the step of locking the position of the mast section relative to the receiving device in the transfer position and before the step of releasing the fixing of the receiving device and tilting the mast section of the first mast, optionally together with the receiving device, around the first mast pivot axis into an angular position which corresponds to inclined mast operating position, a lower mast section of a first mast of the crane is arranged in the receiving device.

The lower mast section of the first mast is connected to the mast section or further mast section of the first mast that is locked in the transfer position to further build up the first mast, The lower mast section of the first mast is connected to the crane base and made tiltable relative to the crane base around the first mast pivot axis.

In an embodiment of the method according to the invention, in the step of fixing the receiving device in a position in which the receiving device central axis is parallel to the central mast axis of the first mast in the mast construction position, the receiving device is fixed in a position in which the receiving device central axis extends vertically.

In an alternative embodiment, the central mast axis of the first mast extends at an angle relative to the vertical, which angle is not 0° and also not 90°, when the first mast is in the construction position.

In an embodiment of the method according to the invention, the method further comprises the step of tilting an upper portion of the first mast away from the central mast axis of the first mast.

In an embodiment of the method according to the invention, the method further comprises the step of tilting an upper portion of a second mast away from the central mast axis of the second mast.

In an embodiment, the method further comprises the steps of releasing the fixing of the receiving device and removing the receiving device.

Optionally, the step of removing the receiving device is done before the first mast is tilted around the first mast pivot axis into an angular position which corresponds to the inclined mast operating position.

Optionally, the method also comprises the step of removing the transfer device.

Optionally, the step of removing the receiving device includes disengaging the receiving device from the crane base.

In these embodiments, the receiving device is removed after it has fulfilled its functions, e.g. when the first mast and/or second mast is assembled. Advantageously the first mast and/or second mast can pivot freely without being obstructed by the receiving device.

In an embodiment, the method comprises the following steps, after assembling the first mast and the removing of the receiving device: —connecting the receiving device to the crane base on a position where a second mast is to be assembled, said position being offset from the first mast, wherein the receiving device is adapted to receive a mast section of the second mast, wherein optionally the receiving device is connected tiltably to the crane base, therewith making the receiving device tiltable relative to the crane base around a second mast pivot axis, which second mast pivot axis extends perpendicular to the receiving device central axis, —fixing the receiving device in a position in which the receiving device central axis is parallel to the central mast axis of the second mast in the mast construction position, —arranging a mast section of the second mast of the crane in the receiving device, —moving the mast section of the second mast relative to the receiving device in the direction of the receiving device central axis from a receiving position into a transfer position, wherein the mast section of the second mast is in an angular position which corresponds to the second mast construction position, —locking the position of the mast section relative to the receiving device in the transfer position to build up the second mast, —optionally releasing the fixing of the receiving device and tilting the second mast, optionally together with the receiving device, around the second mast pivot axis into an angular position which corresponds to the inclined mast operating position.

So, the second mast may be built up in the same way as the first mast, using the same receiving device. Optionally, also the same transfer device and locking device is used. Advantageously, only one receiving device is required the assemble multiple masts.

In an embodiment, the method comprises the following steps, after assembling the first mast and the removing of the receiving device: connecting the receiving device to a further crane base, wherein the receiving device is adapted to receive a mast section of a further first mast, wherein optionally the receiving device is connected tiltably to the further crane base, therewith making the receiving device tiltable relative to the further crane base around a further first mast pivot axis, which further first mast pivot axis extends perpendicular to the receiving device central axis, —fixing the receiving device in a position in which the receiving device central axis is parallel to a central mast axis of the further first mast in the mast construction position, —arranging a mast section of the further first mast of the crane in the receiving device, —moving the mast section of the further first mast relative to the receiving device in the direction of the receiving device central axis from a receiving position into a transfer position, wherein the mast section of the further first mast is in an angular position which corresponds to the further first mast construction position, —locking the position of the mast section relative to the receiving device in the transfer position to build up the further first mast, —optionally releasing the fixing of the receiving device and tilting the further first mast, optionally together with the receiving device, around the further first mast pivot axis into an angular position which corresponds to the inclined mast operating position.

So, the further first mast may be built up in the same way as the first mast, using the same receiving device. Optionally, also the same transfer device and locking device is used. Advantageously, only one receiving device is required the assemble multiple masts. The further first mast and the further crane base may be arranged in the vicinity of the first mast, e.g. on the same hoisting site, or on a remote location. For example, the receiving device may be transferred by road, train, water or air to another hoisting site, e.g. in another country or another continent.

The invention further pertains to a method for disassembling a crane, which crane is a crane according to the invention, which method comprises the following steps: —tilting the first mast, optionally together with the receiving device, around the first mast pivot axis into an angular position which corresponds to the mast construction position, —fixing the receiving device in a position in which the receiving device central axis is parallel to the central mast axis of the first mast in the mast construction position, —removing a mast section of the first mast which is present in the receiving device from the receiving device.

In an embodiment of the method for disassembling a crane according to the invention, the method further comprises the following steps: —after the step of fixing the receiving device in a position in which the receiving device central axis is parallel to the central mast axis of the first mast in the mast construction position, and prior to the step of removing the mast section of the first mast which is present in the receiving device from the receiving device, releasing the locking of the mast section which is in the transfer position and moving this mast section from the transfer position into the receiving position in the receiving device, —then, still prior to the step of removing the mast section of the first mast which is present in the receiving device from the receiving device, locking the position of a subsequent mast section relative to the receiving device in the transfer position.

BRIEF DESCRIPTION OF THE DRAWINGS

The invention will be described in more detail below under reference to the drawing, in which in a non-limiting manner exemplary embodiments of the invention will be shown.

In the drawings, the same reference numerals are used for the same or similar parts of various embodiments of the crane.

DETAILED DESCRIPTION

Figure 1A:
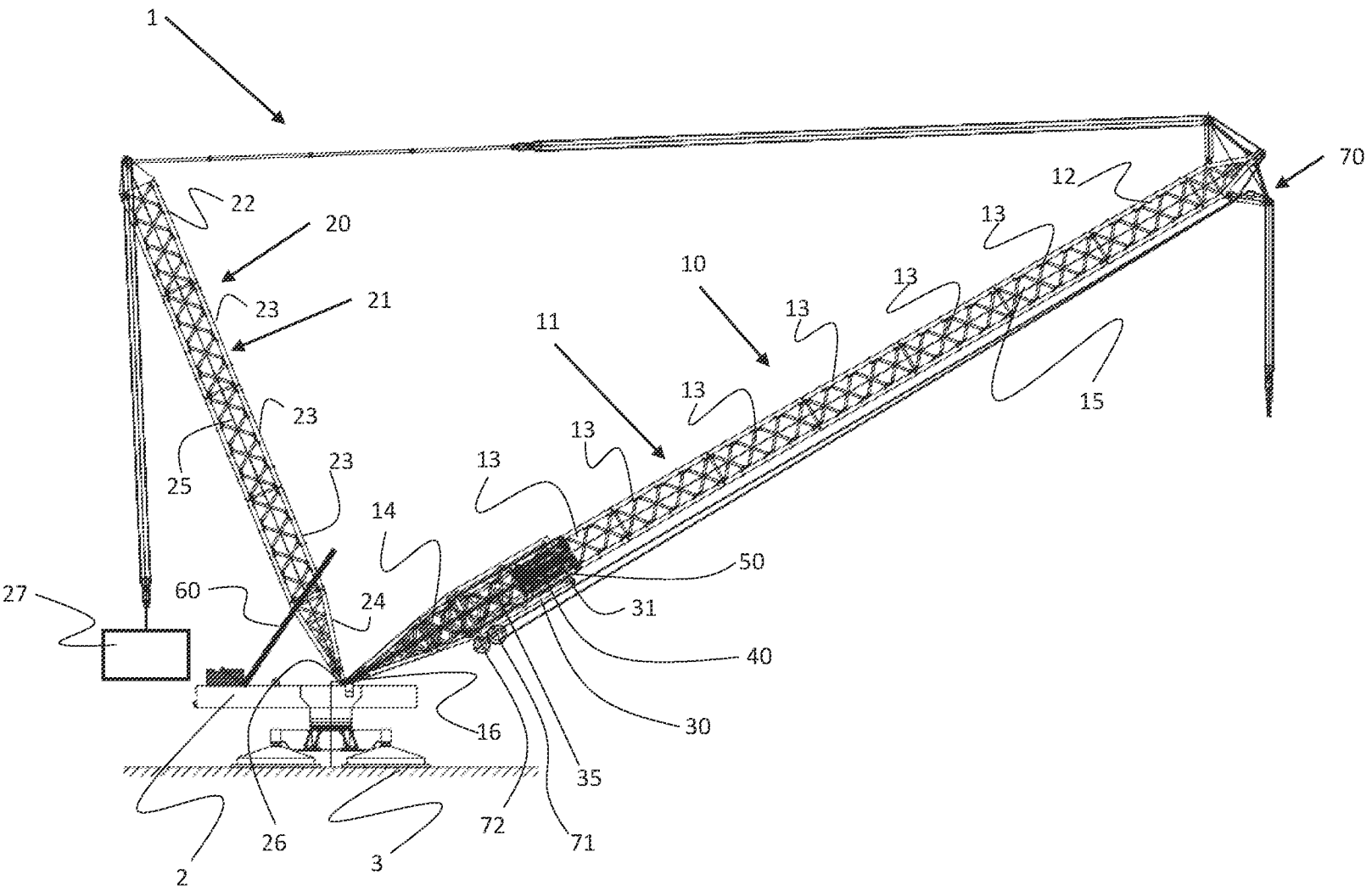
FIG. 1*a* schematically illustrates a first embodiment of a crane according to the invention.

FIG. 1*a* shows, schematically, an embodiment of a crane 1 according to the invention.

The crane 1 of FIG. 1*a* comprises a crane base 2. The crane base 2 can for example be the chassis of a crawler crane, and/or a foot assembly of e.g., a ringer crane. The crane base 2 is arranged on a support surface 3 of a working area. The crane base 2 is pivotable about a substantially vertical crane base pivot axis (not shown)

The crane according to the invention has a first mast 10 which in the embodiment of FIG. 1*a* comprises multiple mast sections 11. In this embodiment, a top mast section 12, multiple intermediate mast sections 13 and a lower mast section 14 are present. As can be seen, the lower mast section 14 is tapered in the direction of the crane base 2.

The first mast 10 has a central axis 15, which extends in the longitudinal direction of the first mast 10. The first mast 10 is tiltable relative to the crane base 2 around a first mast pivot axis 16 within a range of angular positions. The first mast pivot axis 16 extends perpendicular to the central mast axis 15. In the embodiment of FIG. 1*a*, the first mast pivot axis 16 extends in horizontal direction.

The range of angular positions of the first mast 10 includes a mast construction position and an inclined mast operating position. The mast construction position is the angular position of the first mast when the first mast is assembled. The mast operating position is the angular position which the first mast has or can have when a load is lifted by the crane during a hoisting operation. FIG. 1*a* shows the crane 1 with the first mast 10 in a mast operating position. The crane 1 according to FIG. 1*a* is suitable for hoisting a load when the first mast 10 is in the inclined mast operating position shown in FIG. 1*a*.

In the embodiment of FIG. 1*a*, the first mast 10 is the main boom of the crane 1.

In the embodiment of FIG. 1*a*, the lower mast section 14 is connected to the crane base 2 and tiltable relative to the crane base 2 around the first mast pivot axis 15. Therewith, the mechanical loads that are exerted on the first mast 10 during operation of the crane 1 are borne fully or almost fully by the first mast 10.

In the embodiment of FIG. 1, the crane 1 further comprises a second mast 20. In this embodiment, the second mast 20 is a back mast.

The second mast 20 has a central second mast axis 25, and is tiltable relative to the crane base 2 around a second mast pivot axis 26 which extends perpendicular to the central second mast axis 25. The second mast 20 is tiltable relative to the crane base 2 around the second mast pivot axis 26 within a range of angular positions, which range optionally includes a second mast construction position and an inclined second mast operating position.

In the embodiment of FIG. 1*a*, the first mast pivot axis 16 and the second mast pivot axis 26 are positioned close to each other. This allows a small footprint of the crane 1, which is advantageous when the crane 1 has to be used at hoisting locations where there is little space for the crane 1.

The second mast 20 comprises multiple mast sections 21, including a top mast section 22, multiple intermediate mast sections 23 and a lower mast section 24. The lower mast section 24 is tiltably connected to the crane base 2.

Figure 4:
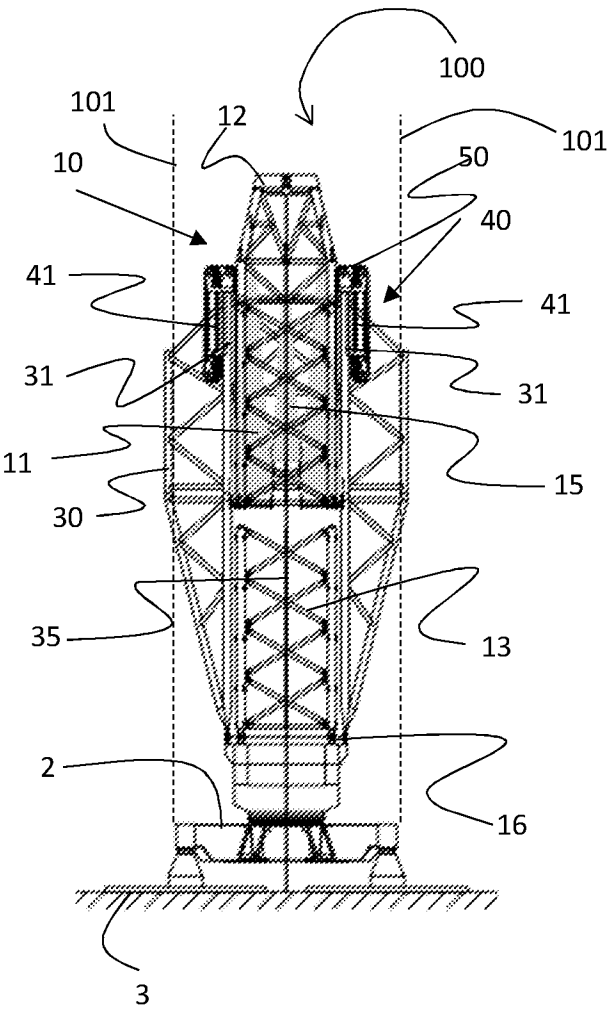
FIG. 4 shows the stage of FIG. 3 in front view.
Figure 3:
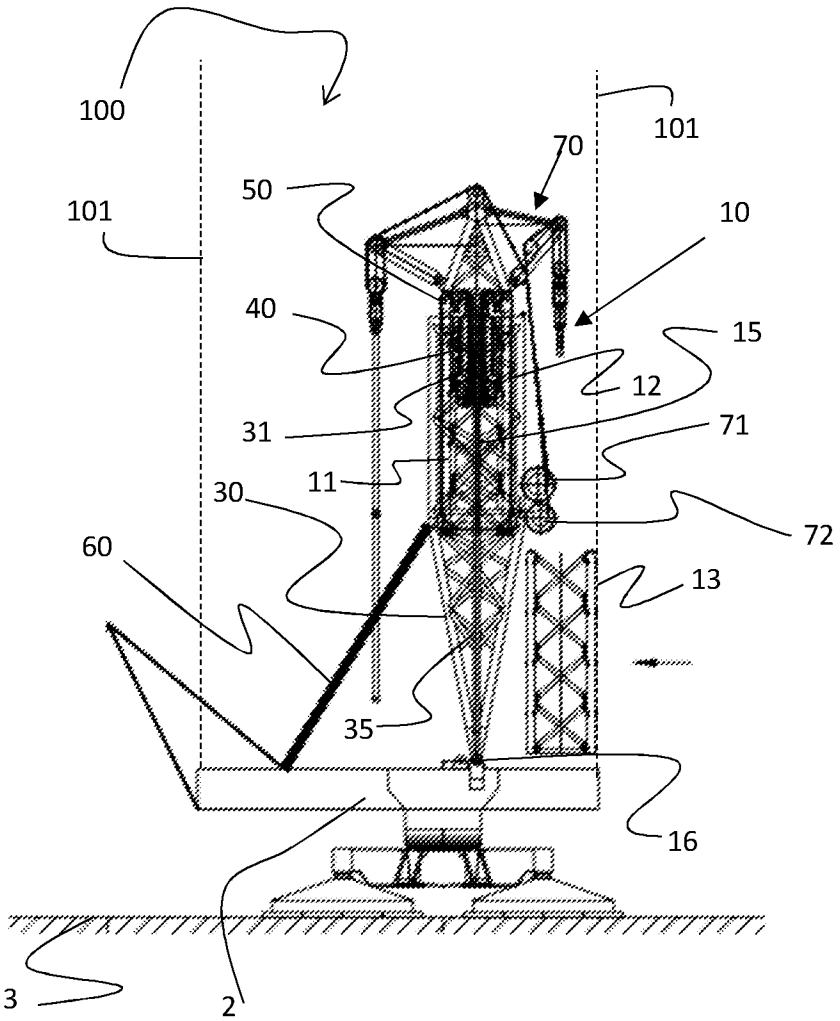
FIG. 3 schematically illustrates a first stage of a first embodiment of the method according to the invention, in a side view.

In the embodiment of FIG. 1*a*, the crane 1 further comprises a receiving device 30, which is adapted to receive a mast section 11, 12, 13, 14 of the first mast 10. As shown throughout the Figures and described herein, the receiving device 30 is a receiver adapted to receive, hold, and guide mast sections for the first mast 10. As best shown in FIGS. 3-4, the receiver 30 can be constructed as a frame structure having side frames. The side frames of the receiver 30 have a space between them for the mast sections (e.g., 13). Additionally, the receiving device or receiver 30 includes a guide 31 that extends in a direction parallel to the receiver's central axis 35 and that is adapted to guide movement of a mast section relative to the receiving device or receiver 30 in the direction of the receiver's central axis 35. During the assembly of the first mast 10, the receiving device or receiver 30 receives a mast section 11, 12, 13, 14 which is to be added to the first mast 10. In the embodiment of FIG. 1*a*, the receiving device 30 successively receives multiple mast sections 11, 12, 13, 14.

The receiving device 30 has a receiving device or receiver central axis 35 which is perpendicular to the first mast pivot axis 16 and parallel to the central mast axis 15. In the embodiment of FIG. 1*a*, the central mast axis 15 and the receiving device mast axis 35 are coaxial with each other.

The receiving device 30 further comprises a mast section guide 31 which is adapted to guide movement of the mast section 11, 12, 13, 14 relative to the receiving device 30 in the direction of the receiving device central axis 30. In the embodiment of FIG. 1*a*, the mast section guide 31 extends in a direction which is parallel to the central mast axis 15 and to the receiving device central axis 35.

The crane 1 according to FIG. 1*a* further comprises a transfer device 40. As shown throughout the Figures and described herein, the transfer device 40 is a mover configured to engage and move mast sections. The transfer device or mast section mover 40 is adapted to engage the mast section 11, 12, 13, 14 of the first mast 10 (either directly or indirectly) and move the mast section 11, 12, 13, 14 of the first mast 10 relative to the receiving device 30 in the direction of the receiving device central axis 35 from a receiving position into a transfer position.

For example, the transfer device or mast section mover 40 is provided with one or more hydraulic cylinders 41 and/or one or more cables to bring the mast section from the receiving position to the transfer position (i.e., to lift the mast section in the side frames of the receiving device or receiver 40).

In the embodiment of FIG. 1*a*, the transfer device is mounted onto the receiving device 30.

The crane 1 according to FIG. 1*a* further comprises a locking device 50, which is adapted to releasably lock the position of the mast section 11, 12, 13, 14 of the first mast 10 relative to the receiving device 30 in the transfer position. As shown throughout the Figures and described herein, the locking device 50 is a lock configured to hold, support, engage, lock, etc. mast sections in place. In particular, the locking device or lock 50 therewith prevents that a mast section 11, 12, 13, 14 slides back from the transfer position into the receiving position. When the locking device or lock 50 locks the mast section 11, 12, 13, 14 in the transfer position, a subsequent mast section 11, 13, 14 can be safely placed in the receiving position in the receiving device or receiver 30.

For example, the locking device 50 may comprise moveable pins which block movement of the mast section 11, 12, 13, 14 from the transfer position towards the receiving position. The pins may for example be hydraulically or pneumatically operated.

In the embodiment of FIG. 1*a*, the locking device 50 is mounted onto the receiving device 30.

The crane 1 according to FIG. 1*a* further comprises a first mast fixing device 60, which is adapted to releasably fix the first mast 10 in the mast construction position. As shown throughout the Figures and described herein, the first mast fixing device 60 is a fixture, holder, support, etc. configured to releasably fix, hold, support, etc. the mast 10 in place. During the assembly and optionally also during disassembly of the first mast 10, for example, the first mast fixing device or fixture 60 holds the first mast in the mast construction position. When the first mast 10 is to be tilted into the inclined mast operating position, the first mast fixing device or fixture 60 releases the first mast 10 to allow the tilting of the first mast 10. In the embodiment of FIG. 1*a*, the first mast fixing device or fixture 60 engages the receiving device or receiver 30 when the first mast 10 is in the mast construction position.

In the embodiment of FIG. 1, the first mast fixing device 60 is adapted to function as a boom stop when the first mast 10 is in the inclined operating position.

In crane 1 of FIG. 1*a*, the receiving device 30 is connected to the crane base 2. FIG. 1*a* further shows that optionally the receiving device 30 is tiltable along with the first mast 10 relative to the crane base 2 around the first mast pivot axis 16.

So, the receiving device 30 moves along with the first mast 10 when the first mast 10 is tilted into the inclined mast operating position. The receiving device central axis 35 remains parallel to and coaxial with the central mast axis 15. Both the receiving device 30 and the first mast tilt 10 about the same pivot axis 16.

The mast section guide 31 forms part of the receiving device 30 and therewith also tilts along with the first mast 10. This way, the mast section guide 31 does not have to be disconnected from and moved out of the way of the first mast 10 before tilting the first mast 10 into the inclined mast operating position.

In the embodiment of FIG. 1*a*, the top mast section 12 of the first mast 10 is provided with at least a part of a hoisting system 70. The hoisting system is used for hoisting loads during the operation of the crane 1, and it can also be used for assembling the second mast 20 of the crane 1.

In the embodiment of FIG. 1*a*, the hoisting system 70 of the crane 1 is provided with a cable system having multiple sheaves. A sheave 71 of the cable system is arranged on the receiving device 30. The hoisting device 70 further comprises a winch 72. Also the winch 72 is arranged on the receiving device 30.

In the inclined mast operating position the first mast 10 is tilted in the first direction relative to the mast construction position. In the shown embodiment, the first mast 10 tilts away from the second mast 20 in the first direction, which is to the right in FIG. 1*a*. The sheave 71 and the winch 72 are arranged on a first side of the first mast 10 which corresponds with the first direction, i.e. the right side in FIG. 1*a*.

Figure 1B:
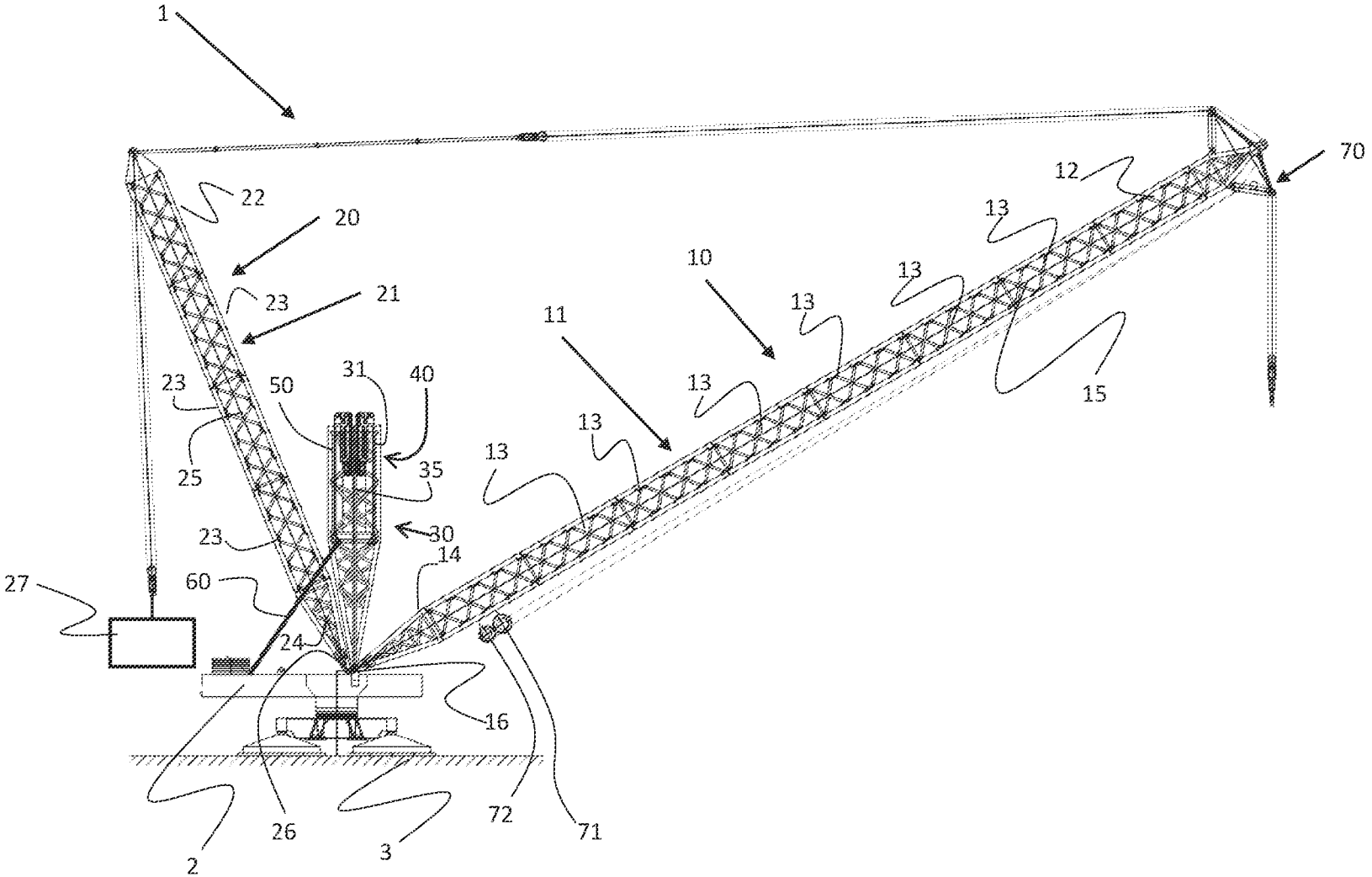
FIG. 1*b* schematically illustrates a second embodiment of a crane according to the invention.

FIG. 1*b* shows a second embodiment of a crane 1 according to the invention. In FIG. 1*b*, the same reference numerals are used as in FIG. 1*b*. The crane 1 of FIG. 1*b* comprises a crane base 2. The crane base 2 can for example be the chassis of a crawler crane, and/or a foot assembly of e.g. a ringer crane. The crane base 2 is arranged on a support surface 3 of a working area. The crane base 2 is pivotable about a substantially vertical crane base pivot axis (not shown).

The crane according to the invention has a first mast 10 which in the embodiment of FIG. 1*b* comprises multiple mast sections 11. In this embodiment, a top mast section 12, multiple intermediate mast sections 13 and a lower mast section 14 are present. As can be seen, the lower mast section 14 is tapered in the direction of the crane base 2.

The first mast 10 has a central axis 15, which extends in the longitudinal direction of the first mast 10. The first mast 10 is tiltable relative to the crane base 2 around a first mast pivot axis 16 within a range of angular positions. The first mast pivot axis 16 extends perpendicular to the central mast axis 15. In the embodiment of FIG. 1*b*, the first mast pivot axis 16 extends in horizontal direction.

The range of angular positions of the first mast 10 includes a mast construction position and an inclined mast operating position. The mast construction position is the angular position of the first mast when the first mast is assembled. The mast operating position is the angular position which the first mast has or can have when a load is lifted by the crane during a hoisting operation. FIG. 1*b* shows the crane 1 with the first mast 10 in a mast operating position. The crane 1 according to FIG. 1*b* is suitable for hoisting a load when the first mast 10 is in the inclined mast operating position shown in FIG. 1*b*.

In the embodiment of FIG. 1*b*, the first mast 10 is the main boom of the crane 1.

In the embodiment of FIG. 1*b*, the lower mast section 14 is connected to the crane base 2 and tiltable relative to the crane base 2 around the first mast pivot axis 15. Therewith, the mechanical loads that are exerted on the first mast 10 during operation of the crane 1 are borne fully or almost fully by the first mast 10.

In the embodiment of FIG. 1, the crane 1 further comprises a second mast 20. In this embodiment, the second mast 20 is a back mast.

The second mast 20 has a central second mast axis 25 and is tiltable relative to the crane base 2 around a second mast pivot axis 26 which extends perpendicular to the central second mast axis 25. The second mast 20 is tiltable relative to the crane base 2 around the second mast pivot axis 26 within a range of angular positions, which range optionally includes a second mast construction position and an inclined second mast operating position.

In the embodiment of FIG. 1*b*, the first mast pivot axis 16 and the second mast pivot axis 26 are positioned close to each other. This allows a small footprint of the crane 1, which is advantageous when the crane 1 has to be used at hoisting locations where there is little space for the crane 1.

The second mast 20 comprises multiple mast sections 21, including a top mast section 22, multiple intermediate mast sections 23 and a lower mast section 24. The lower mast section 24 is tiltably connected to the crane base 2.

In the embodiment of FIG. 1*b*, the crane 1 further comprises a receiving device or receiver 30, which is adapted to receive a mast section 11, 12, 13, 14 of the first mast 10. During the assembly of the first mast 10, the receiving device 30 receives a mast section 11, 12, 13, 14 which is to be added to the first mast 10. In the embodiment of FIG. 1*b*, the receiving device 30 successively receives multiple mast sections 11, 12, 13, 14.

The receiving device or receiver 30 has a receiving device or receiver central axis 35. In the embodiment of FIG. 1*b*, the central mast axis 15 and the receiving device mast axis 35 are coaxial with each other during assembly of the first mast 10, but not in the situation shown in FIG. 1*b*.

The receiving device 30 further comprises a mast section guide 31 which is adapted to guide movement of the mast section 11, 12, 13, 14 relative to the receiving device 30 in the direction of the receiving device central axis 30. In the embodiment of FIG. 1*b*, the mast section guide 31 extends in a direction which is parallel to the central mast axis 15 and to the receiving device central axis 35.

The crane 1 according to FIG. 1*b* further comprises a transfer device or mast section mover 40. The transfer device or mast section mover 40 is adapted to engage the mast section 11, 12, 13, 14 of the first mast 10 (either directly or indirectly) and move the mast section 11, 12, 13, 14 of the first mast 10 relative to the receiving device or receiver 30 in the direction of the receiving device central axis 35 from a receiving position into a transfer position.

The transfer device 40 is for example provided with one or more hydraulic cylinders and/or one or more cables to bring the mast section from the receiving position to the transfer position.

In the embodiment of FIG. 1*b*, the transfer device is mounted onto the receiving device 30.

The crane 1 according to FIG. 1*b* further comprises a locking device or lock 50, which is adapted to releasably lock the position of the mast section 11, 12, 13, 14 of the first mast 10 relative to the receiving device or receiver 30 in the transfer position. The locking device or lock 50 therewith prevents that a mast section 11, 12, 13, 14 slides back from the transfer position into the receiving position. When the locking device or lock 50 locks the mast section 11, 12, 13, 14 in the transfer position, a subsequent mast section 11, 13, 14 can be safely placed in the receiving position in the receiving device or receiver 30.

For example, the locking device or lock 40 may comprise moveable pins which block movement of the mast section 11, 12, 13, 14 from the transfer position towards the receiving position. The pins may for example be hydraulically or pneumatically operated.

In the embodiment of FIG. 1*b*, the locking device 50 is mounted onto the receiving device 30.

The crane 1 according to FIG. 1*b* further comprises a first mast fixing device or fixture 60, which is adapted to releasably fix the first mast 10 in the mast construction position. During the assembly and optionally also during disassembly of the first mast 10, the first mast fixing device or fixture 60 holds the first mast in the mast construction position. When the first mast 10 is to be tilted into the inclined mast operating position, the first mast fixing device or fixture 60 releases the first mast 10 to allow the tilting of the first mast 10. In the embodiment of FIG. 1*b*, the first mast fixing device or fixture 60 engages the receiving device or receiver 30 when the first mast 10 is in the mast construction position.

In the embodiment of FIG. 1, the first mast fixing device 60 is adapted to function as a boom stop when the first mast 10 is in the inclined operating position.

In crane 1 of FIG. 1*b*, the receiving device 30 is connected to the crane base 2. FIG. 1*b* further shows that, different from the embodiment shown in FIG. 1*a*, optionally the receiving device 30 does not tilt along with the first mast 10 relative to the crane base 2 around the first mast pivot axis 16.

So, the receiving device 30 remains substantially upright, in the same position as during assembly of the first mast 10.

In the embodiment of FIG. 1*b*, the top mast section 12 of the first mast 10 is provided with at least a part of a hoisting system 70. The hoisting system is used for hoisting loads during the operation of the crane 1, and it can also be used for assembling the second mast 20 of the crane 1.

In the embodiment of FIG. 1*b*, the hoisting system 70 of the crane 1 is provided with a cable system having multiple sheaves. A sheave 71 of the cable system is arranged on the receiving device 30. The hoisting device 70 further comprises a winch 72. Also the winch 72 is arranged on the receiving device 30.

In the inclined mast operating position the first mast 10 is tilted in the first direction relative to the mast construction position. In the shown embodiment, the first mast 10 tilts away from the second mast 20 in the first direction, which is to the right in FIG. 1*b*. The sheave 71 and the winch 72 are arranged on a first side of the first mast 10 which corresponds with the first direction, i.e. the right side in FIG. 1*b*.

Figure 2:
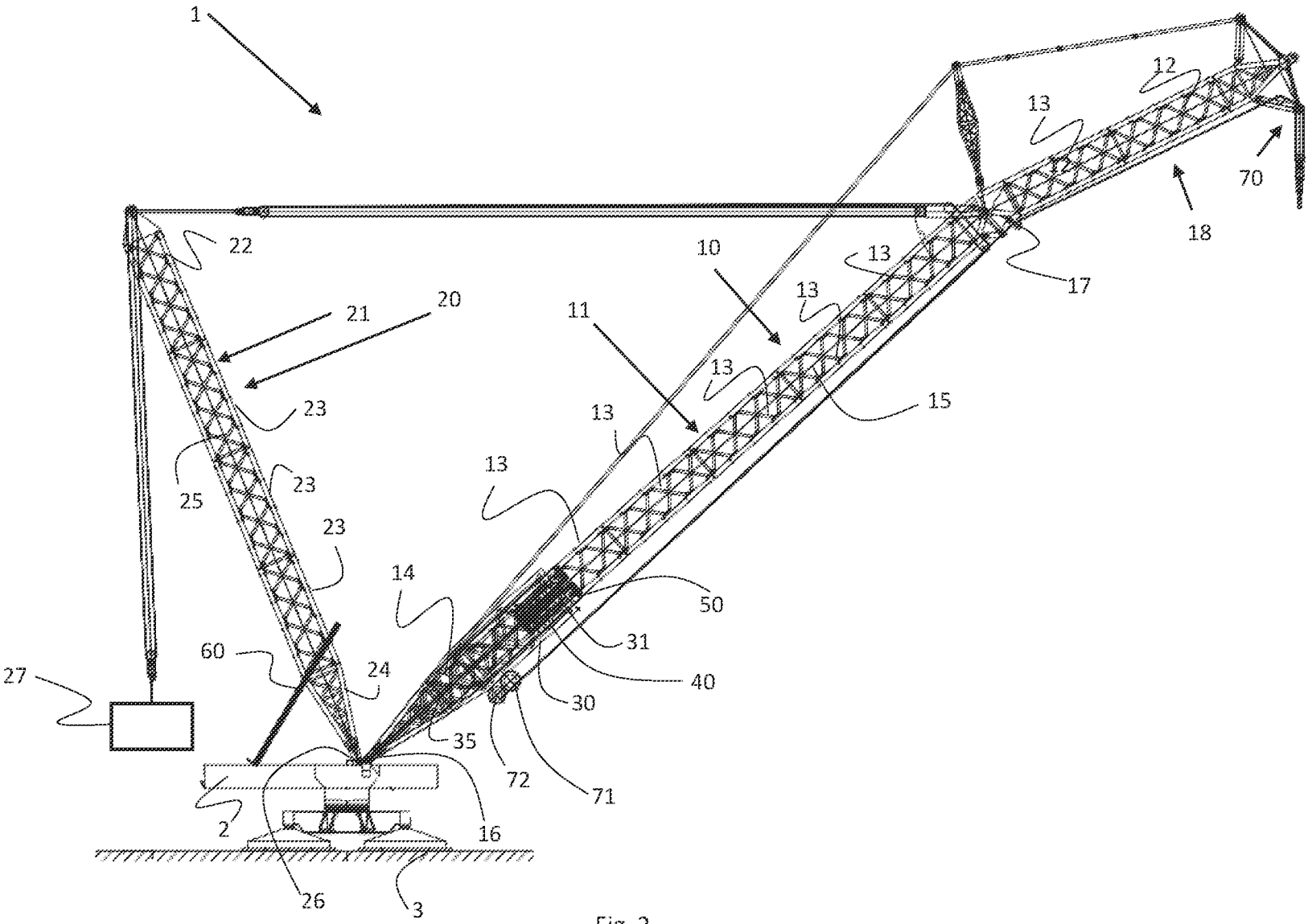
FIG. 2 schematically illustrates a third embodiment of a crane according to the invention.

FIG. 2 shows, schematically, a third embodiment of a crane according to the invention. In FIG. 2, the same reference numerals are used as in FIG. 1*a* and FIG. 1*b* for the same or similar parts of the crane 1.

The crane 1 of FIG. 2 comprises a crane base 2. The crane base 2 can for example be the chassis of a crawler crane, and/or a foot assembly of e.g. a ringer crane. The crane base 2 is arranged on a support surface 3 of a working area. The crane base 2 is pivotable about a substantially vertical crane base pivot axis (not shown)

The crane according to the invention has a first mast 10 which in the embodiment of FIG. 2 comprises multiple mast sections 11. In this embodiment, a top mast section 12, multiple intermediate mast sections 13 and a lower mast section 14 are present.

The first mast 10 has a central axis 15, which extends in the longitudinal direction of the first mast 10. The first mast 10 is tiltable relative to the crane base 2 around a first mast pivot axis 16 within a range of angular positions. The first mast pivot axis 16 extends perpendicular to the central mast axis 15. In the embodiment of FIG. 2, the first mast pivot axis 16 extends in horizontal direction.

The range of angular positions of the first mast 10 includes a mast construction position and an inclined mast operating position. The mast construction position is the angular position of the first mast when the first mast is assembled. The mast operating position is the angular position which the first mast has or can have when a load is lifted by the crane during a hoisting operation. FIG. 2 shows the crane 1 with the first mast 10 in a mast operating position. The crane 1 according to FIG. 2 is suitable for hoisting a load when the first mast 10 is in the inclined mast operating position shown in FIG. 2.

In the embodiment of FIG. 2, the first mast 10 is the main boom of the crane 1.

In the embodiment of FIG. 2, the first mast 10 comprises a tilting member 17 which allows an upper portion 18 of the first mast 10 to tilt away from the central mast axis 15 of the first mast 10.

In the embodiment of FIG. 2, the upper portion 18 of the first mast 10 comprises the top mast section 12 and one intermediate mast section 13, but a different number of intermediate mast sections 13 is possible as well. It is also possible that the upper mast section 18 comprises only the top mast section 12.

For example, the tilting member 17 is a tilting member as described in NL 2019511.

In the embodiment of FIG. 2, the lower mast section 14 is connected to the crane base 2 and tiltable relative to the crane base 2 around the first mast pivot axis 16. Therewith, the mechanical loads that are exerted on the first mast 10 during operation of the crane 1 are borne fully or almost fully by the first mast 10.

In the embodiment of FIG. 2, the crane 1 further comprises a second mast 20. In this embodiment, the second mast 20 is a back mast.

The second mast 20 has a central second mast axis 25, and is tiltable relative to the crane base 2 around a second mast pivot axis 26 which extends perpendicular to the central second mast axis 25. The second mast 20 is tiltable relative to the crane base 2 around the second mast pivot axis 26 within a range of angular positions, which range optionally includes a second mast construction position and an inclined second mast operating position.

In the embodiment of FIG. 2, the first mast pivot axis 16 and the second mast pivot axis 26 are positioned close to each other. This allows a small footprint of the crane 1, which is advantageous when the crane 1 has to be used at hoisting locations where there is little space for the crane 1.

The second mast 20 comprises multiple mast sections 21, including a top mast section 22, multiple intermediate mast sections 23 and a lower mast section 24. The lower mast section 24 is tiltably connected to the crane base 2.

In the embodiment of FIG. 2, the crane 1 further comprises a receiving device or receiver 30, which is adapted to receive a mast section 11, 12, 13, 14 of the first mast 10. During the assembly of the first mast 10, the receiving device or receiver 30 receives a mast section 11, 12, 13, 14 which is to be added to the first mast 10. In the embodiment of FIG. 2, the receiving device or receiver 30 successively receives multiple mast sections 11, 12, 13, 14.

The receiving device or receiver 30 has a receiving device or receiver central axis 35 which is perpendicular to the first mast pivot axis 16 and parallel to the central mast axis 15. In the embodiment of FIG. 2, the central mast axis 15 and the receiving device or receiver mast axis 25 are coaxial with each other.

The receiving device 30 further comprises a mast section guide 31 which is adapted to guide movement of the mast section 11, 12, 13, 14 relative to the receiving device 30 in the direction of the receiving device central axis 30. In the embodiment of FIG. 2, the mast section guide 31 extends in a direction which is parallel to the central mast axis 15 and to the receiving device central axis 35.

The crane 1 according to FIG. 2 further comprises a transfer device or mast section mover 40. The transfer device or mast section mover 40 is adapted to engage the mast section 11, 12, 13, 14 of the first mast 10 (either directly or indirectly) and move the mast section 11, 12, 13, 14 of the first mast 10 relative to the receiving device or receiver 30 in the direction of the receiving device or receiver central axis 35 from a receiving position into a transfer position.

The transfer device 40 is for example provided with one or more hydraulic cylinders and/or one or more cables to bring the mast section from the receiving position to the transfer position.

In the embodiment of FIG. 2, the transfer device is mounted onto the receiving device 30.

The crane 1 according to FIG. 2 further comprises a locking device or lock 50, which is adapted to releasably lock the position of the mast section 11, 12, 13, 14 of the first mast 10 relative to the receiving device or receiver 30 in the transfer position. The locking device or lock 50 therewith prevents that a mast section 11, 12, 13, 14 slides back from the transfer position into the receiving position. When the locking device or lock 50 locks the mast section 11, 12, 13, 14 in the transfer position, a subsequent mast section 11, 13, 14 can be safely placed in the receiving position in the receiving device or receiver 30.

For example, the locking device or lock 40 may comprise moveable pins which block movement of the mast section 11, 12, 13, 14 from the transfer position towards the receiving position. The pins may for example be hydraulically or pneumatically operated.

In the embodiment of FIG. 2, the locking device 50 is mounted onto the receiving device 30.

The crane 1 according to FIG. 2 further comprises a first mast fixing device of fixture 60, which is adapted to releasably fix the first mast 10 in the mast construction position. During the assembly and optionally also during disassembly of the first mast 10, the first mast fixing device or fixture 60 holds the first mast in the mast construction position. When the first mast 10 is to be tilted into the inclined mast operating position, the first mast fixing device or fixture 60 releases the first mast 10 to allow the tilting of the first mast 10. In the embodiment of FIG. 2, the first mast fixing device or fixture 60 engages the receiving device or receiver 30 when the first mast 10 is in the mast construction position.

In the embodiment of FIG. 1, the first mast fixing device 60 is adapted to function as a boom stop when the first mast 10 is in the inclined operating position.

In crane 1 of FIG. 2, the receiving device 30 is connected to the crane base 2 and tiltable along with the first mast 10 relative to the crane base 2 around the first mast pivot axis 16.

So, the receiving device 30 moves along with the first mast 10 when the first mast 10 is tilted into the inclined mast operating position. The receiving device central axis 35 remains parallel to and coaxial with the central mast axis 15. Both the receiving device 30 and the first mast tilt 10 about the same pivot axis 16.

The mast section guide 31 forms part of the receiving device 30 and therewith also tilts along with the first mast 10. This way, the mast section guide 31 does not have to be disconnected from and moved out of the way of the first mast 10 before tilting the first mast 10 into the inclined mast operating position.

In the embodiment of FIG. 2, the top mast section 12 of the first mast 10 is provided with at least a part of a hoisting system 70. The hoisting system is used for hoisting loads during the operation of the crane 1, and it can also be used for assembling the second mast 20 of the crane 1.

In the embodiment of FIG. 2, the hoisting system 70 of the crane 1 is provided with a cable system having multiple sheaves. A sheave 71 of the cable system is arranged on the receiving device 30. The hoisting device 70 further comprises a winch 72. Also the winch 72 is arranged on the receiving device 30.

In practice during operation the second mast 20 is connected to a ballast (27). The crane 1 is configured to move the ballast 27 closer or further away from the crane base 2.

FIG. 3 shows a first stage of a first embodiment of the method according to the invention, in side view. FIG. 4 shows the stage of FIG. 3 in front view.

In the stage of the embodiment of the method according to the invention as shown in FIG. 3 and FIG. 4, a crane base 2 has been arranged on a support surface 3 of a working area. The crane base 2 can for example be the chassis of a crawler crane, and/or a foot assembly of e.g. a ringer crane.

A receiving device or receiver 30 which is adapted to receive a mast section 11, 12, 13, 14 of the first mast 10 of a crane, e.g. a crane according to the invention, and which has a receiving device or receiver central axis 35, is tiltably connected to the crane base 2. The receiving device or receiver 30 is tiltable relative to the crane base 2 around first mast pivot axis 16. The first mast pivot axis 16 extends perpendicular to the receiving device or receiver central axis 35.

A transfer device or mast section mover 40, a locking device or lock 50, a sheave 71 of hoisting system 70 and a winch of hoisting system 70 are arranged on the receiving device or receiver 30. The transfer device or mast section mover 40 comprises hydraulic cylinders 41.

The receiving device 30 is fixed in a position in which the receiving device central axis 35 is parallel to the central mast axis 15 of the first mast 10 in the mast construction position. The first mast 10 is not fully present at this stage of the method, but the receiving device 30 is fixed in a position in which the receiving device central axis 35 is parallel to the direction the central mast axis 15 of the first mast 10 will be in when the first mast is in the mast construction position. First mast fixing device 60 engages the receiving device 30 in order to fix the receiving device 30 in this position.

In this embodiment, the mast construction position is vertical, i.e., the central mast axis 15 of the first mast 10 extends vertically when the first mast 10 is in the mast construction position. In this embodiment therefore, the receiving device 30 is fixed in a position in which the receiving device central axis 35 extends vertically.

FIG. 3 and FIG. 4 further show that an imaginary assembly space 100 can be defined. The assembly space 100 extends vertically upwards above the crane base 2. Outer borders 101 of the assembly space 100 extend vertically upwards from outer borders of the crane base 2. As can be seen, in the stage of FIG. 3 and FIG. 4, the first mast 10 is arranged completely within the assembly space 100. Although the assembly space 100 in not shown in all figures for the sake of clarity, it will be clear that the first mast 10 remains within the assembly space 100 until the first mast 100 is assembled in the mast construction position.

In the stage of FIG. 3 and FIG. 4, a mast section 11 of a first mast 10 of the crane is arranged in the receiving device 30. In this example, the mast section 11 is a top mast section 12.

The top mast section 12 comprises a part of hoisting system 70. The hoisting system 70 further comprise sheave 71 and winch 72. Hoisting cable 73 runs over winch 71, sheave 71 and is connected to the parts of the hoisting system 70 on the top mast section 12.

FIG. 3 and FIG. 4 show the top mast section 12 in the receiving position. The top mast section 12 is engaged by the mast section guides 31.

In the embodiment of the method as shown in FIG. 3-11, there is sufficient space in the receiving device 30, to arrange an intermediate mast section 13 below the top mast section 12 which is in the receiving position. This is however not necessary. In other embodiments, the receiving position may be closer to the crane base 2.

In the example of FIG. 3 and FIG. 4, in the receiving position, the mast section guide 31 (which in this example comprises two guide elements, arranged on opposite sides of the receiving device 30) engages the top mast section 12 which is arranged in the receiving device 30.

Figure 6:
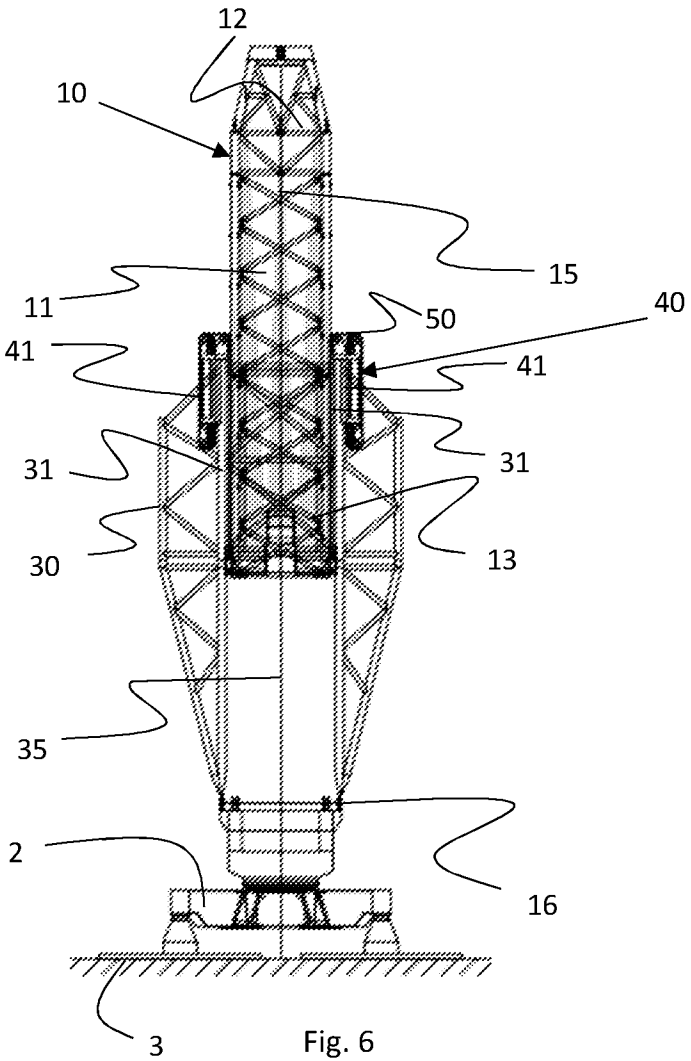
FIG. 6 shows the stage of FIG. 5 in front view.
Figure 5:
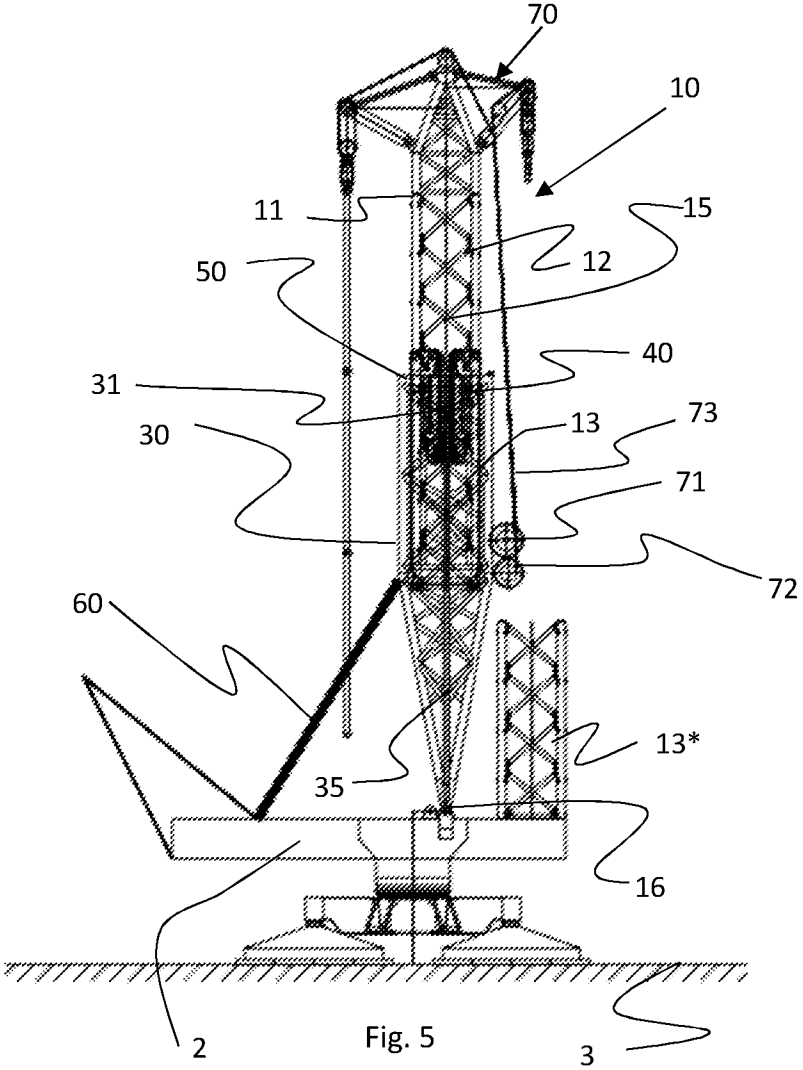
FIG. 5 schematically shows a subsequent stage of a first embodiment of the method according to the invention, in a side view.

FIG. 5 shows a subsequent stage of a first embodiment of the method according to the invention, in side view. FIG. 6 shows the stage of FIG. 5 in front view.

In this stage of the first embodiment of the method according to the invention, the top mast section 12 of the first mast 10 is moved by a transfer device or mast section mover 40 relative to the receiving device 30 in the direction of the receiving device central axis 35 from the receiving position into a transfer position. FIG. 5 and FIG. 6 show the top mast section 12 in the transfer position. In this example, the top mast section 12 projects from the receiving device 30. The transfer device or mast section mover 40, which comprises hydraulic cylinders 41, engages the top mast section 12 directly. In an alternative embodiment, the transfer device or mast section mover 40 may engage the top mast section 12 indirectly, for example by engaging a part of the first mast 10 which is connected to the top mast section 12.

When the transfer device 40 moves the top mast section 12 from the receiving position to the transfer position, the top mast section 12 of the first mast 10 is in an angular position which corresponds to the first mast construction position, which is in this embodiment vertical.

When the top mast section 12 is in the transfer position, the position of the top mast section 12 relative to the receiving device 30 is locked by locking device 50 in the transfer position to build up the first mast 10.

In this embodiment, a subsequent mast section, which is in this case an intermediate mast section 13, is connected to the top mast section 12 before the top mast section 12 is moved from the receiving position into the transfer position. This way, when the top mast section 12 is moved into the transfer position, the intermediate mast section 13 that is attached to the top mast section 12 is at the same time moved into the receiving position in the receiving device 30.

When the intermediate mast section 13 is held in the receiving position, the top mast section may be released by the locking device 50 so that it can be moved further upwards when more mast sections are added to the first mast 10.

The intermediate mast section 13 is then moved from the receiving position into the transfer position. This movement takes place in the direction of the receiving device central axis 35. The position of the intermediate mast section 13 is then locked by the locking device 50 relative to the receiving device 30 in the transfer position.

When the transfer device 40 moves the intermediate mast section 13 from the receiving position to the transfer position, the intermediate mast section 13 of the first mast 10 is in an angular position which corresponds to the first mast construction position, in this example vertical. The top mast section 12 which was in the transfer position is therewith moved away from the transfer position in a direction that is parallel to the central mast axis 15 to further build up the first mast 10.

From the situation shown in FIG. 5 and FIG. 6, further intermediate mast sections 13 may be added to further build up the first mast 10.

In the embodiment of FIG. 3-11, a further intermediate mast section 13* of the first mast 10 is connected to the intermediate mast section directly above it. In the situation shown in FIG. 5, the further intermediate mast section 13* is connected to the intermediate mast section 13 which is in the first mast 10 just below the top mast section 12.

The intermediate mast section 13 is then moved from the receiving position into the transfer position. The further intermediate mast section 13* moves along with the intermediate mast section 13 and is therewith arranged in the receiving position in the receiving device 30. The intermediate mast 13 section is locked in the transfer position.

These steps are repeated as often as necessary to obtain the desired length of the first mast 10.

In the embodiment of FIG. 3-11, a lower mast section 14 (see FIG. 7) is added to the first mast 10. This lower mast section 14 is connected to the crane base 2 and tiltable relative to the crane base 2 around the first mast pivot axis 16. In this embodiment, the mechanical loads that are exerted on the first mast during operation of the crane 1 are borne by the first mast 10, and not or only to a limited extent by the receiving device 30.

The lower mast section 14 is the last mast section that is added to the first mast 10. It is arranged in the receiving device 30 and connected to the lowest of the intermediate mast sections 13* of the first mast. This lowest of the intermediate mast sections 13* of the first mast is for example at that time locked in the transfer position. Alternatively, another mast section is at that time locked in the transfer position, and the lower mast section is connected to that locked mast section via the lowest intermediate mast section.

The lower mast section of the first mast is connected to the crane base 2 and made tiltable relative to the crane base 2 around the first mast pivot axis 16.

Figures 7, 8:
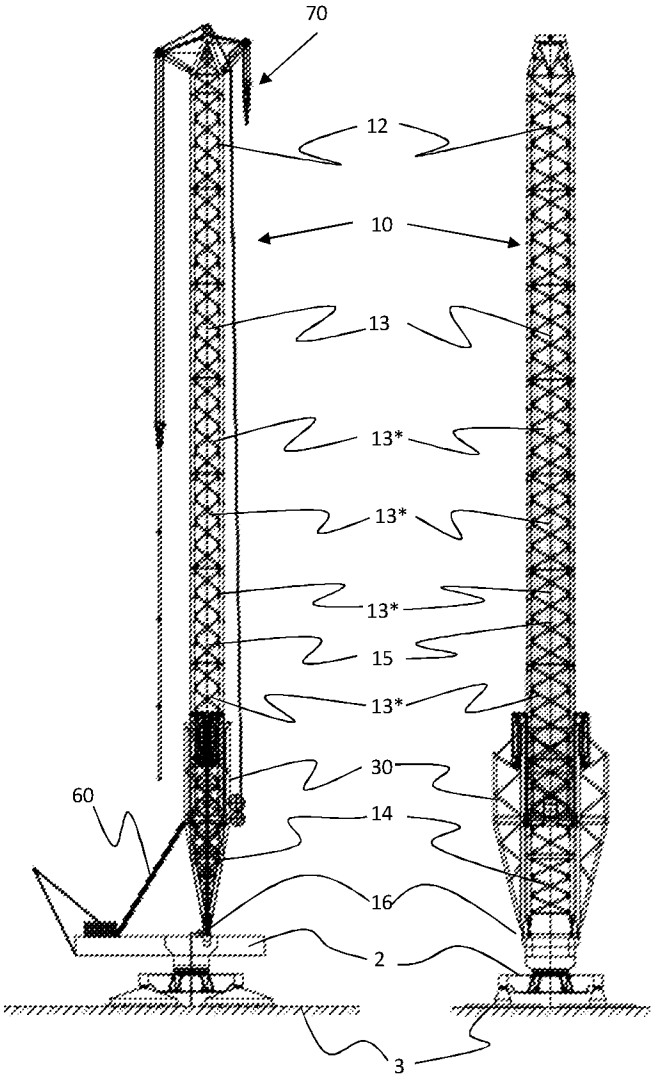
FIG. 7 shows the first mast as assembled in accordance with the first embodiment of the method according to the invention, in a side view.
FIG. 8 shows the first mast as assembled in accordance with the first embodiment of the method according to the invention, in a front view.

This results in the situation that is shown in FIG. 7 and FIG. 8. FIG. 7 shows the first mast in side view, FIG. 8 shows the first mast in front view.

Figure 9:
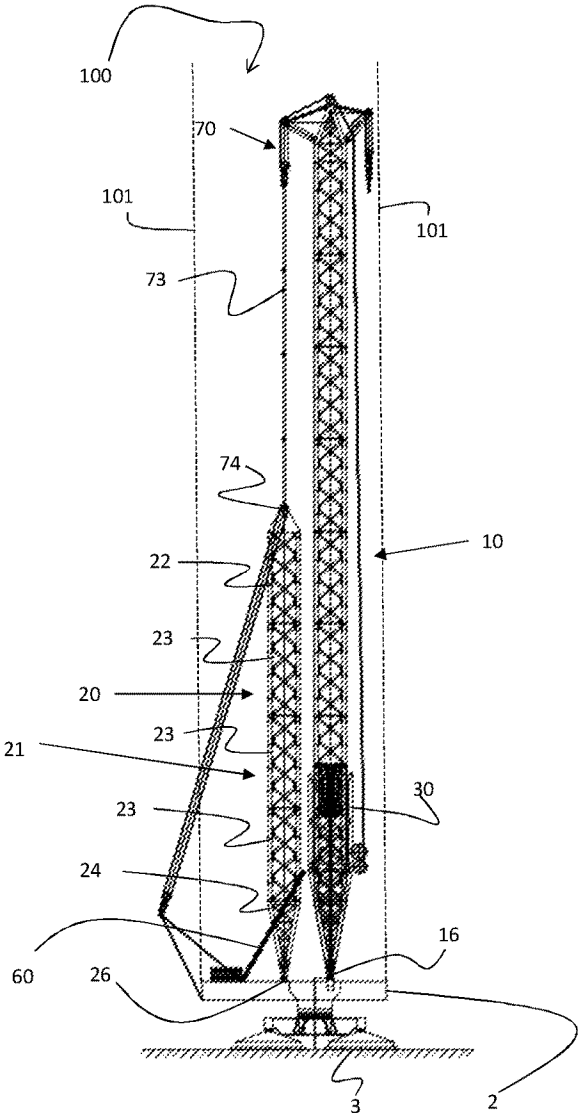
FIG. 9 shows a subsequent stage in the first embodiment of the method according to the invention.

FIG. 9 shows a subsequent stage in the first embodiment of the method according to the invention.

In the embodiment of FIG. 3-11, the first mast 10 comprises at least a part of a hoisting system 70. This part of the hoisting system 70 can be used to build up the second mast 20 of the crane 1. The hoisting system comprises a cable 73 and a connector 74. The second mast 20 in this example comprises multiple mast sections 21, including a top mast section 22, multiple intermediate mast sections 23 and a lower mast section 24. The second mast 20 is tiltable around a second mast pivot axis 26, which is parallel to the first mast pivot axis 16.

As shown in FIG. 9, in this embodiment, the top mast section 22 of the second mast 20 is connected to the hoisting system 70, e.g. by lowering the connector 74 of the hoisting system 70 and connecting the connector to the top mast section of the second mast.

Then, this top mast section 22 is moved upwards into a position which allows to connect an intermediate mast section 23 to the top mast section 22 of the second mast 20, in particular to the lower edge of this top mast section 22. The intermediate mast section 23 is then arranged below the top mast section 22 of the second mast 20 and connected to this top mast section 22 of the second mast 20.

In this embodiment, more intermediate mast sections 23 are added. The top mast section 22 and intermediate mast sections 23 which are connected thereto are lifted higher and further intermediate mast sections 23 are added and connected to the mast sections 21, 22, 23 of the second mast 20 which are already hanging from the connector 74 of the hoisting system 70.

The last mast section 21 that is added is the lower mast section 24 of the second mast 20. This lower mast section 24 is connected to the lowest of the intermediate mast sections 22 that are suspended from the connector 74 of the hoisting system 70 and the lower mast section 24 of the second mast 20 is connected to the crane base 2 and made tiltable relative to the crane base 2 around the second mast pivot axis 26.

FIG. 9 also shows the assembly space 100. As can be seen, the second mast 20 is within the assembly space 100. It will become clear that the second mast 20 remains in the assembly space 100 during assembly of the second mast 20. It can also be seen in FIG. 9 that the first mast 10 is completely in the assembly space 100 when the first mast 10 is arranged vertically, i.e., corresponding with the mast construction position in the shown embodiment.

Figure 10:
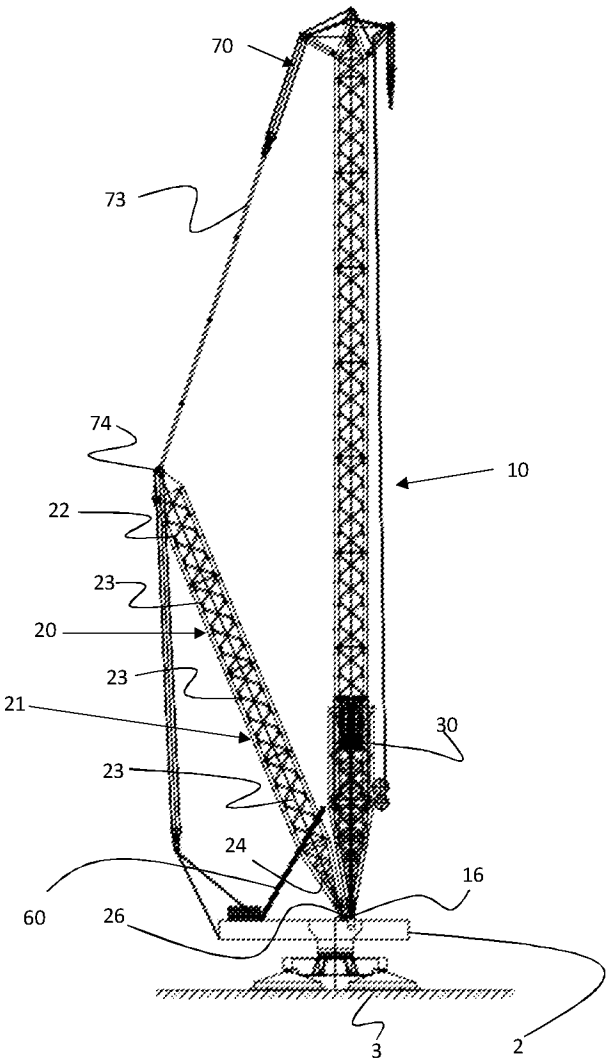
FIG. 10 shows a further subsequent stage in the first embodiment of the method according to the invention.

FIG. 10 shows a further subsequent stage in the first embodiment of the method according to the invention.

In this stage, the second mast 20 is tilted around the second mast pivot axis 26 into its second mast operating position, which is an inclined second mast operating position (i.e., an angular position which is at an angle other than 0° and also other than 90° relative to the vertical).

The second mast pivot axis 26 is then optionally moved toward the first mast pivot axis 16.

Figure 11:
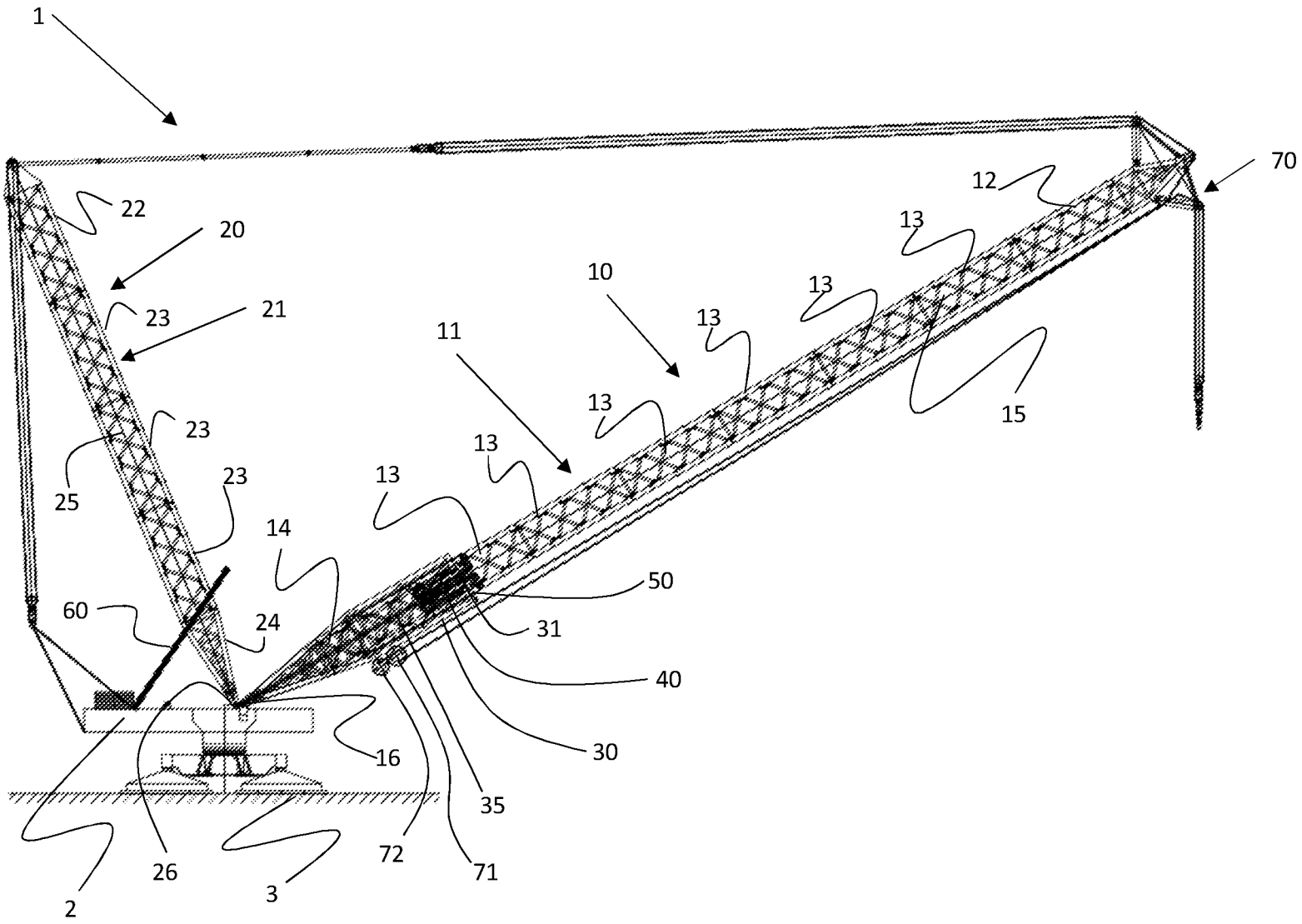
FIG. 11 shows a further subsequent stage in the first embodiment of the method according to the invention.

FIG. 11 shows a further subsequent stage in the first embodiment of the method according to the invention.

In this stage, the fixing of the receiving device 30 is released. The receiving device 30 and the first mast 10 are tilted together around the first mast pivot axis 16 into an angular position which corresponds to the inclined mast operating position.

Figure 12:
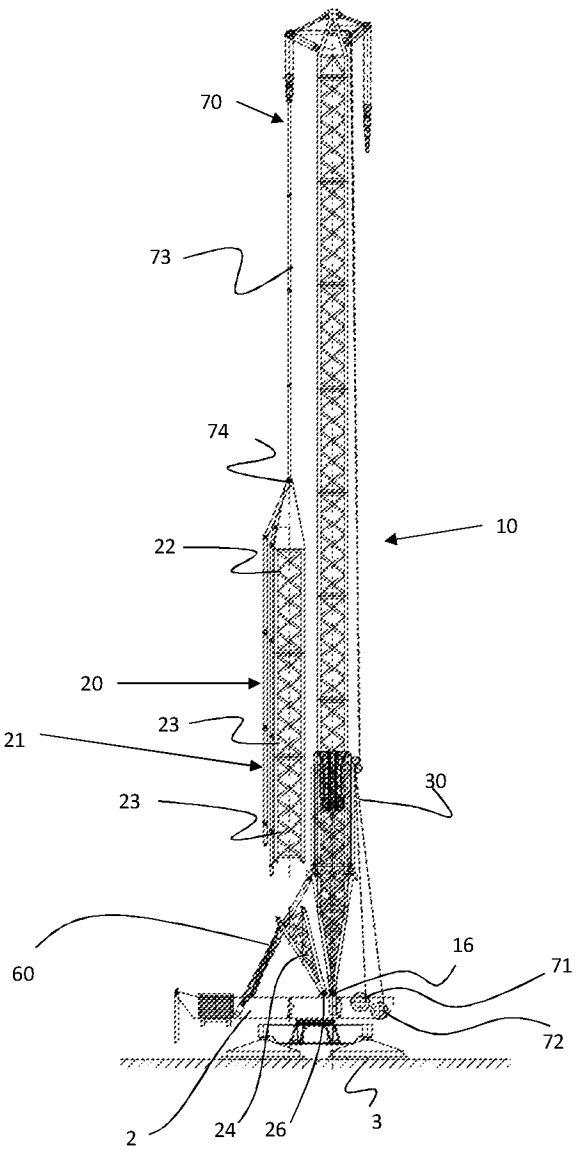
FIG. 12 shows a step in a first variant of the first embodiment of the method according to the invention.
Figure 13:
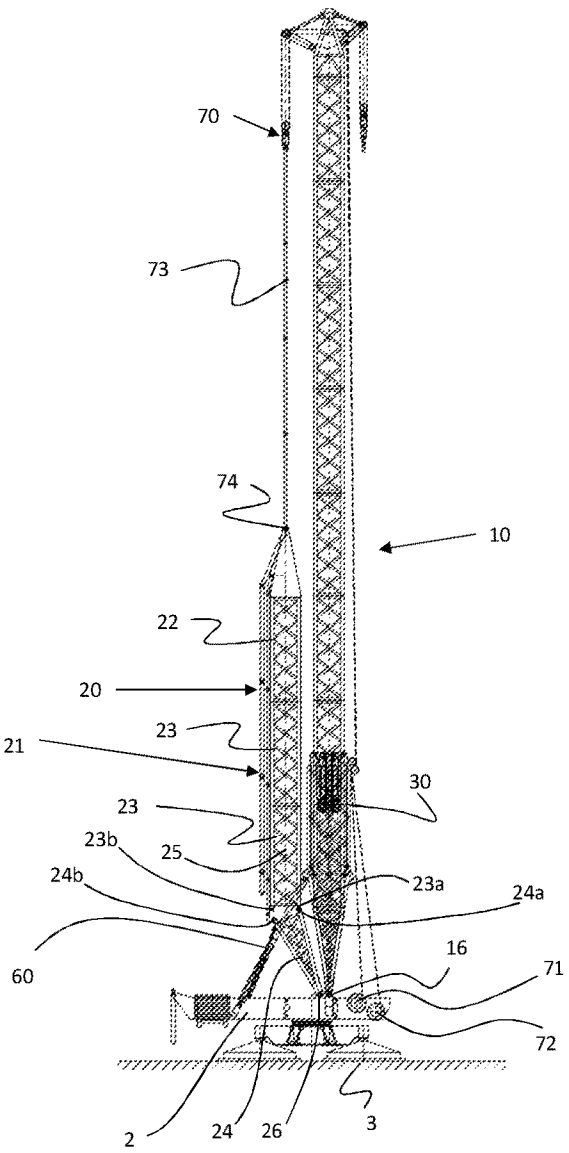
FIG. 13 shows a subsequent step in the first variant of the first embodiment of the method according to the invention.

FIG. 12 and FIG. 13 pertain to a first variant of the first embodiment of the method in accordance with FIG. 3-11.

In the variant of FIG. 12 and FIG. 13, the initial steps of the assembly of the crane are carried out in conformity with FIG. 3-8.

After carrying out the steps as described in relation to FIG. 3-8, in this variant a subsequent step is carried out, which is shown in FIG. 12.

In the variant of FIG. 12-13, the first mast 10 comprises at least a part of a hoisting system 70. This part of the hoisting system 70 can be used to build up the second mast 20 of the crane 1. The hoisting system comprises a cable 73 and a connector 74. The second mast 20 in this example comprises multiple mast sections 21, including a top mast section 22, multiple intermediate mast sections 23 and a lower mast section 24. The second mast 20 is tiltable around a second mast pivot axis 26, which is parallel to the first mast pivot axis 16.

As shown in FIG. 12, in this variant, the top mast section 22 of the second mast 20 is connected to the hoisting system 70, e.g. by lowering the connector 74 of the hoisting system 70 and connecting the connector to the top mast section of the second mast.

Then, this top mast section 22 is moved upwards into a position which allows to connect an intermediate mast section 23 to the top mast section 22 of the second mast 20, in particular to the lower edge of this top mast section 22.

The intermediate mast section 23 is then arranged below the top mast section 22 of the second mast 20 and connected to this top mast section 22 of the second mast 20.

In this embodiment, more intermediate mast sections 23 are added. The top mast section 22 and intermediate mast sections 23 which are connected thereto are lifted higher and further intermediate mast sections 23 are added and connected to the mast sections 21, 22, 23 of the second mast 20 which are already hanging from the connector 74 of the hoisting system 70.

Either before, during or after the connection of the top mast section 22 of the second mast 20 is to the hoisting system 70 and/or the connection and addition of one or more intermediate mast sections 23, a lower mast section 24 is connected to the crane base 2 and made tiltable relative to the crane base 2 around the second mast pivot axis 26.

In this embodiment, the second mast pivot axis 26 is already in the position relative to the first mast pivot axis 16 that it will have during operation of the crane 1.

The lower mast section 24 of the second mast 20 may be arranged in an inclined position, as is shown in FIG. 12.

FIG. 13 shows a subsequent step in this variant of the first embodiment.

In this step, a first upper part 24*a* of the lower mast section 24 is pivotably connected to a first lower part 23*a* of the lowest of the intermediate sections 23. This results in the situation shown in FIG. 13.

Then, the top mast section 22 and the intermediate mast sections 23 (which are all connected to each other) are tilted relative to the lower mast section 24, which results in a tilting of the central mast axis 25 of the second mast 20. This tilting for example takes place around the connection between first upper part 24*a* of the lower mast section 24 and a first lower part 23*a* of the lowest of the intermediate sections 23.

When this tilting is done, a second upper part 24*b* of the lower mast section 24 and a second lower part 23*b* of the lowest of the intermediate sections 23 are connected to each other, preferably in a non-tiltable way.

This results in the situation which is shown in FIG. 11.

It is noted that in the variant of FIG. 12 and FIG. 13, the hoisting system 70 of the crane 1 is provided with a cable system having multiple sheaves. In this variant, a sheave 71 of the cable system is arranged on the crane base 2. The hoisting device 70 further comprises a winch 72. Also the winch 72 is arranged on the crane base 2. The position of the sheave 71 and the winch is not specifically coupled to the variant shown in FIG. 12 and FIG. 13, the same position can be applied in other embodiments of the method and the crane according to the invention as well. Likewise, it is possible to arrange sheave 71 an winch 72 on the receiving device 30 in the variant of FIG. 12 and FIG. 13 as well.

Figure 14:
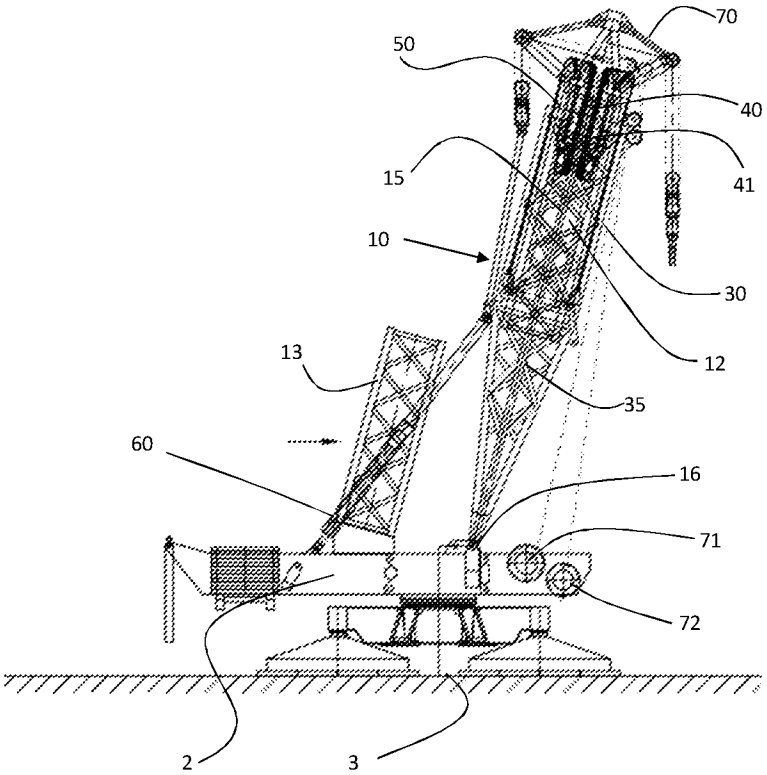
FIG. 14 shows a step in a second variant of the first embodiment of the method according to the invention.

FIG. 14 shows a second variant of the first embodiment of the method according to the invention.

In the variant of FIG. 14, the central mast axis 15 of the first mast 10 extends at an angle relative to the vertical, which angle is not 0° and also not 90°, when the first mast 10 is in the construction position.

FIG. 14 shows an alternative for the stage of the first embodiment of the method according to the invention which is shown in FIG. 3 and FIG. 4.

In the variant of FIG. 14, a crane base 2 has been arranged on a support surface 3 of a working area. The crane base 2 can for example be the chassis of a crawler crane, and/or a foot assembly of e.g., a ringer crane.

A receiving device or receiver 30 which is adapted to receive a mast section 11, 12, 13, 14 of the first mast 10 of a crane, e.g. a crane according to the invention, and which has a receiving device or receiver central axis 35, is tiltably connected to the crane base 2. The receiving device or receiver 30 is tiltable relative to the crane base 2 around first mast pivot axis 16. The first mast pivot axis 16 extends perpendicular to the or receiver central axis 35.

A transfer device or mast section mover 40 and a locking device or lock 50, are arranged on the receiving device or receiver 30. The transfer device or mast section mover 40 for example comprises hydraulic cylinders 41. A sheave 71 of hoisting system 70 and a winch of hoisting system 70 are arranged on the crane base 2 in this example, but alternatively they may be arranged on the receiving device or receiver 30.

The receiving device 30 is fixed in a position in which the receiving device central axis 35 is parallel to the central mast axis 15 of the first mast 10 in the mast construction position. The first mast 10 is not fully present at this stage of the method, but the receiving device 30 is fixed in a position in which the receiving device central axis 35 is parallel to the direction the central mast axis 15 of the first mast 10 will be in when the first mast is in the mast construction position. First mast fixing device or fixture 60 engages the receiving device or receiver 30 in order to fix the receiving device or receiver 30 in this position.

In this embodiment, the mast construction position is inclined, i.e. the central mast axis 15 of the first mast 10 extends at an angle relative to the vertical which angle is not 0° or 90° when the first mast 10 is in the mast construction position. In this embodiment therefore, the receiving device 30 is fixed in a position in which the receiving device central axis 35 extends under the same angle as the central mast axis 15.

In the stage of FIG. 14, a mast section 11 of a first mast 10 of the crane is arranged in the receiving device 30. In this example, the mast section 11 is a top mast section 12.

The top mast section 12 comprises a part of hoisting system 70. The hoisting system 70 further comprise sheave 71 and winch 72. Hoisting cable 73 runs over winch 71, sheave 71 and is connected to the parts of the hoisting system 70 on the top mast section 12.

FIG. 14 shows the top mast section 12 in the receiving position. The top mast section 12 is engaged by the mast section guides 31.

In this second variant of the first embodiment of the method according to the invention, there is sufficient space in the receiving device 30, to arrange an intermediate mast section 13 below the top mast section 12 which is in the receiving position. This is however not necessary. In other embodiments, the receiving position may be closer to the crane base 2.

In this second variant of the first embodiment of the method according to the invention, in the receiving position, the mast section guide (which in this example comprises two guide elements, arranged on opposite sides of the receiving device 30) engages the top mast section 12 which is arranged in the receiving device 30.

Figure 15:
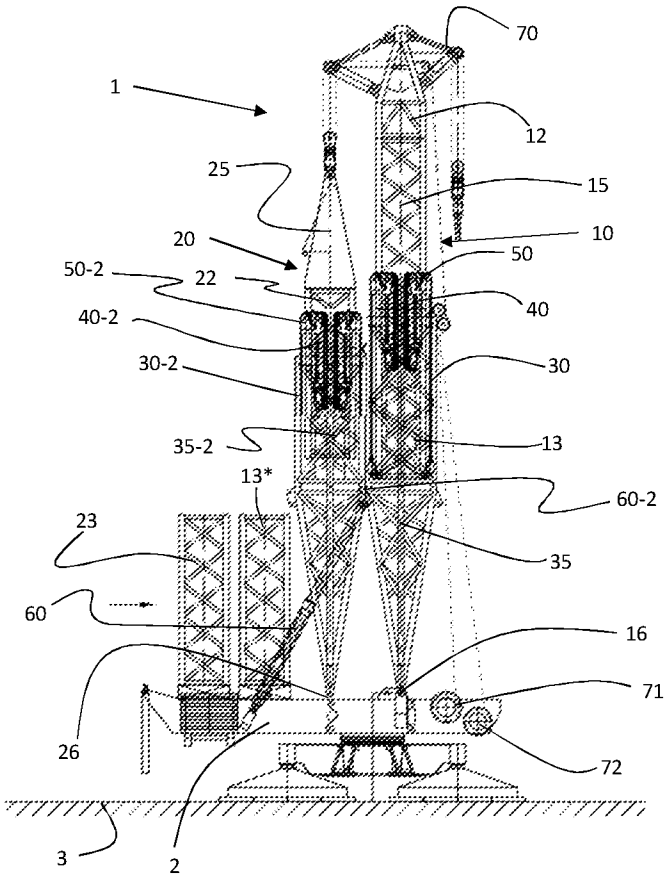
FIG. 15 shows a step in a second embodiment of the method according to the invention.

FIG. 15 shows a step in a second embodiment of the method according to the invention.

In this embodiment, the crane 1 which is assembled comprises a first mast 10 and a second mast 20.

In this embodiment, at least a part of the first mast 10 of the crane 1 is assembled as shown in FIG. 3-6. Optionally, the entire first mast 10 is assembled as is shown in FIG. 3-8.

Then, the second mast 20 is assembled. This is done in the same way as the assembly of the first mast 10.

In this embodiment, a second mast receiving device or receiver 30-2 is pivotably connected to the crane base 2. The second mast receiving device or receiver 30-2 is adapted to receive a mast section 22, 23 of the second mast 10, and has a second mast receiving device or receiver central axis 35-2. Therewith, the second mast receiving device or receiver 35-2 is made tiltable relative to the crane base 2 around the second mast pivot axis 26. The second mast pivot axis 26 extends perpendicular to the receiving device or receiver central axis 35-2. In this embodiment, the second mast pivot axis 26 extends parallel to the first mast pivot axis 16, i.e., in horizontal direction.

Then, the second mast receiving device 35-2 is fixed in a position in which the second mast receiving device central axis 35-2 is parallel to the central mast axis 25 of the second mast 20 in the mast construction position by a second mast fixing device or fixture 60-2. The second mast fixing device or fixture 60-2 can be connected to the crane base 2, for example in a similar way as the first mast fixing device or fixture 60 is shown in FIG. 15. Alternatively, the second mast fixing device or fixture 60-2 connected the second mast receiving device 30-2 to the receiving device 30 which is associated with the first mast 10.

In this embodiment, the central mast axis 25 of the second mast 20 extends in vertical direction in the mast construction position. Optionally, the central mast axis 25 of the second mast 20 in the mast construction position of the second mast 20 extends parallel to the central mast axis 15 of the first mast 10 in the mast construction position of the first mast 10.

Then, the top mast section 22 of a second mast 20 of the crane 1 is arranged in the second mast receiving device 30-2.

The top mast section 22 of the second mast 20 is moved relative to the second mast receiving device 35-2 in the direction of the second mast receiving device central axis 35-2 from a receiving position into a transfer position. The top mast section 22 of the second mast 20 is in an angular position which corresponds to the second mast construction position.

When the top mast section 22 of the second mast 20 is in the transfer position, the position of the top mast section 22 of the second mast 20 relative to the second mast receiving device 30-2 is locked by the second mast locking device 50-2 in the transfer position to build up the second mast 10.

Optionally, a subsequent mast section, which is in this case an intermediate mast section 23 of the second mast 20, is connected to the top mast section 22 of the second mast 20 before the top mast section 22 of the second mast 20 is moved from the receiving position into the transfer position. This way, when the top mast section 22 is moved into the transfer position, the intermediate mast section 23 that is attached to the top mast section 22 is at the same time moved into the receiving position in the second mast 20 receiving device 30-2.

When the intermediate mast section 23 of the second mast 20 is held in the receiving position, the top mast section 22 of the second mast 20 may be released by the locking device 50-2 so that it can be moved further upwards when more mast sections are added to the second mast 20.

The intermediate mast section 23 of the second mast 20 is then moved from the receiving position into the transfer position. This movement takes place in the direction of the second mast receiving device central axis 35-2. The position of the intermediate mast section 23 is then locked by the locking device 50-2 relative to the second mast receiving device 30-20 in the transfer position.

When the transfer device 40-2 which is associated with the second mast 20 moves the intermediate mast section 23 from the receiving position to the transfer position, the intermediate mast section 23 of the second mast 20 is in an angular position which corresponds to the second mast construction position, in this example vertical. The top mast section 22 of the second mast 20 which was in the transfer position is therewith moved away from the transfer position in a direction that is parallel to the central mast axis 25 of the second mast 20 to further build up the second mast 20.

Further intermediate mast sections 23 may be added to further build up the second mast 20.

Then, a lower mast section is added to the second mast 20. This lower mast section 14 is connected to the crane base 2 and tiltable relative to the crane base 2 around the second mast pivot axis 26.

Then, the fixing of the second mast receiving device 30-2 is released and the second mast receiving device 35-2 and the second mast 20 are tilted together around the second mast pivot axis 26 into an angular position which corresponds to the inclined mast operating position.

So, the second mast 20 may be built up in the same way as the first mast.

Optionally, in the step of fixing the second mast receiving device 30-2 in a position in which the second mast receiving device central axis 35-2 is parallel to the central mast axis 25 of the second mast 20 in the mast construction position, the second mast receiving device 30-2 is fixed in a position in which the second receiving device central axis 35-2 extends vertically.

In an alternative embodiment, the central mast axis 25 of the second mast 20 extends at an angle relative to the vertical, which angle is not 0° and also not 90°, when the second mast 20 is in the construction position.

In a variant of this embodiment, the second mast 20 is build up before the first mast 10 is finished. For example, intermediate mast sections 13, 23 are added the first mast 10 and the second mast 20 simultaneously. Alternatively, intermediate mast sections 13, 23 are added to the first mast 10 and the second mast 20 in an alternating way, for example first an intermediate mast section 13 is added to the first mast 10, then an intermediate mast section 23 is added to the second mast 20, and then optionally an intermediate mast section 13 is added to the first mast 10 again.

The crane 1 may then be further assembled as shown in FIGS. 10 and 11.

The crane 1 which has been assembled in accordance with the first or second embodiment of the method according to the invention, including the variants of the first embodiment as described above, can be disassembled in accordance the method according to the invention for disassembling a crane.

In an embodiment of the method according to the invention for disassembling a crane 1, the starting point is the situation as shown in FIG. 11.

From this situation, the receiving device 30 and the first mast 10 are tilted together around the first mast pivot axis 16 into an angular position which corresponds to the mast construction position. The receiving device 30 is fixed in a position in which the receiving device central axis 35 is parallel, in this example coaxial, to the central mast axis 15 of the first mast 10 in the mast construction position This results in the situation of FIG. 10.

Then, the second mast 20 is brought into an upright position and disconnected from the second mast pivot axis 26 and/or from the crane base 2. The second mast 20 can be first brought into the upright position and then disconnected, or vice versa. This results in the situation of FIG. 10.

Then, the second mast can be disassembled by disconnecting the mast sections 21, 24, 233, 22 from each other, e.g., while gradually lowering the connector 74. When the second mast is disassembled, the situation of FIG. 7 and FIG. 8 results.

Then, if there is a mast section 11, 12, 13, 14 of the first mast present in the receiving position in the receiving device 30, the mast section just above that mast section in the receiving position is locked in the transfer position, e.g., by the locking device 50.

The mast section in the receiving device 30 is then disconnected from the remainder of the first mast 10 and removed from the receiving device 30.

Then, the position of the mast section in the transfer position is unlocked and that mast section is moved from the transfer position into the receiving position, e.g., by the transfer device 40. The mast section just above that mast section in the receiving position is locked in the transfer position, e.g., by the locking device 50.

The mast section in the receiving device 30 is then disconnected from the remainder of the first mast 10 and removed from the receiving device 30.

This is repeated until the first mast is disassembled.

If desired, the receiving device 30 can be disconnected from the crane base 2.

The invention may e.g. be summarized by the following clauses:

1. Crane, which crane (1) comprises: —a crane base (2), —a first mast (10) having a central mast axis (15), wherein the first mast (10) comprises a mast section (11, 12, 13, 14), and the first mast (10) is tiltable relative to the crane base (2) around a first mast pivot axis (16) within a range of angular positions, which range of angular positions includes a mast construction position and an inclined mast operating position, wherein the first mast pivot axis (16) extends perpendicular to the central mast axis (15), —a receiving device or receiver (30), which is adapted to receive the mast section (11, 12, 13, 14) of the first mast (10), which receiving device (30) has a receiving device central axis (35) which is perpendicular to the first mast pivot axis (16) and parallel to the central mast axis (15), and a mast section guide (31) which is adapted to guide movement of the mast section (11, 12, 13, 14) relative to the receiving device (30) in the direction of the receiving device central axis (35), —a transfer device or mast section mover (40), which is adapted to move the mast section (11, 12, 13, 14) of the first mast (10) relative to the receiving device (30) in the direction of the receiving device central axis (35) from a receiving position into a transfer position, —a locking device or lock (50), which is adapted to releasably lock the position of the mast section (11, 12, 13, 14) of the first mast (10) relative to the receiving device (30) in the transfer position, —a first mast fixing device or fixture (60), which is adapted to releasably fix the first mast (10) in the mast construction position, wherein the receiving device (30) is connected to the crane base (2) and tiltable along with the first mast (10) relative to the crane base (2) around the first mast pivot axis (16).

2. Crane according to clause 1, wherein the first mast (10) comprises a lower mast section (14) which is connected to the crane base (2) and tiltable relative to the crane base (2) around the first mast pivot axis (16).

3. Crane according to any of the preceding clauses, wherein the central mast axis (15) of the first mast (10) extends vertically when the first mast (10) is in the construction position.

4. Crane according to any of the preceding clauses, wherein a mast section of the first mast (10) is provided with at least a part of a hoisting system (70).

5. Crane according to any of the preceding clauses, wherein the crane (1) further comprises a second mast (20), wherein optionally the first mast (10) is a main boom, and the second mast (20) is a back mast.

6. Crane according to any of the preceding clauses, wherein the first mast (10) comprises a tilting member (17) which allows an upper portion (18) of the first mast (10) to tilt away from the central mast axis (15) of the first mast (10).

7. Method for assembling a crane, which crane comprises a first mast (10) having a central mast axis (15), wherein the first mast (10) comprises a mast section (11, 12, 13, 14), and the first mast (10) is tiltable relative to a crane base (2) around a first mast pivot axis (16) within a range of angular positions, which range includes a mast construction position and an inclined mast operating position, wherein the first mast pivot axis (16) extends perpendicular to the central mast axis (15), which method comprises the following steps: —tiltably connecting a receiving device or receiver (30) which is adapted to receive a mast section (11, 12, 13, 14) of the first mast (10) and which has a receiving device or receiver central axis (35) to the crane base (2), therewith making the receiving device (30) tiltable relative to the crane base (2) around the first mast pivot axis (16), which first mast pivot axis (16) extends perpendicular to the receiving device central axis (35), —fixing the receiving device (30) in a position in which the receiving device central axis (35) is parallel to the central mast axis (15) of the first mast (10) in the mast construction position, —arranging a mast section (11, 12, 13, 14) of a first mast (10) of the crane (1) in the receiving device (30), —moving the mast section (11, 12, 13, 14) of the first mast (10) relative to the receiving device (30) in the direction of the receiving device central axis (35) from a receiving position into a transfer position, wherein the mast section of the first mast (10) is in an angular position which corresponds to the mast construction position of the first mast (10), —locking the position of the mast section (11, 12, 13, 14) relative to the receiving device (30) in the transfer position to build up the first mast (10), —releasing the fixing of the receiving device (30) and tilting the receiving device (30) and the first mast (10) together around the first mast pivot axis (16) into an angular position which corresponds to the inclined mast operating position.

8. Method according to clause 7, wherein the method further comprises the following steps: —after the step of locking the position of the mast section (11, 12, 13, 14) relative to the receiving device (30) in the transfer position and before the step of releasing the fixing of the receiving device (30) and tilting the receiving device (30) and the mast section (11, 12, 13, 14) of the first mast (10) together around the first mast pivot axis (16) into an angular position which corresponds to inclined mast operating position, arranging a further mast section (13, 14) of a first mast (10) of the crane (1) in the receiving device (30), —connecting the further mast section (13, 14) of the first mast (10) to the mast section (11, 12, 13) of the first mast (10) that is locked in the transfer position, —unlocking the mast section (11, 12, 13) of the first mast (10) in the transfer position, —moving the further mast section (13, 14) of the first mast (10) relative to the receiving device (30) in the direction of the receiving device central axis (35) from a receiving position into the transfer position, wherein the mast section of the first mast (10) is in an angular position which corresponds to the mast construction position of the first mast, and therewith moving the mast section (11, 12, 13) which was in the transfer position away from the transfer position in a direction that is parallel to the central mast axis (15) to further build up the first mast (10), —locking the position of the further mast section (13, 14) relative to the receiving device (30) in the transfer position.

9. Method according to any of the clauses 7-8, wherein the method further comprises the following steps: —after the step of locking the position of the mast section relative to the receiving device (30) in the transfer position and before the step of releasing the fixing of the receiving device (30) and tilting the receiving device (30) and the mast section of the first mast (10) together around the first mast pivot axis (16) into an angular position which corresponds to inclined mast operating position, arranging a lower mast section (14) of the first mast (10) of the crane in the receiving device, —connecting the lower mast section (14) of the first mast (10) to the mast section or further mast section of the first mast (10) that is locked in the transfer position to further build up the first mast (10), —connecting the lower mast section (14) of the first mast (10) to the crane base (2) and making the lower mast section (14) of the first mast (10) tiltable relative to the crane base (2) around the first mast pivot axis (16).

10. Method according to any of the clauses 7-9, wherein at least one mast section of the first mast (10) comprises at least a part of a hoisting system (70), which method further comprises the following steps: —connecting a hoisting cable (73) which is connected to the at least part of the hoisting system of the mast section of the first mast (10) to a mast section (21, 22, 23, 24) of a second mast (20), —connecting the mast section (21, 22, 23, 24) of the second mast to the crane base (2) to build up the second mast (20) and making the second mast (20) tiltable relative to the crane base (2) around a second mast pivot axis (26), which is parallel to the first mast pivot axis (16).

11. Method according to clause 10, wherein the step of connecting a hoisting cable (73) which is connected to the at least part of the hoisting system (70) of the mast section of the first mast (10) to a mast section (21, 22, 23, 24) of the second mast (20) takes place before releasing the fixing of the receiving device (30) and tilting the receiving device (30) and the mast of the first mast (10) together around the first mast pivot axis (16) into an angular position which corresponds to the inclined mast operating position.

12. Method according to clause 10, wherein the method further comprises the step of tilting the second mast (20) into an inclined second mast operating position.

13. Method according to any of the clauses 7-11, wherein in the step of fixing the receiving device (30) in a position in which the receiving device central axis (35) is parallel to the central mast axis (15) of the first mast (10) in the mast construction position, the receiving device (30) is fixed in a position in which the receiving device central axis (35) extends vertically.

14. Method according to any of the clauses 7-13, wherein the method further comprises the step of tilting an upper portion (18) of the first mast (10) away from the central mast axis (15) of the first mast (10).

15. Method for disassembling a crane, which crane is a crane (1) according to clause 1, which method comprises the following steps: —tilting the receiving device (30) and the first mast (10) together around the first mast pivot axis (16) into an angular position which corresponds to the mast construction position, —fixing the receiving device (30) in a position in which the receiving device central axis (35) is parallel to the central mast axis (15) of the first mast (10) in the mast construction position, —removing a mast section of the first mast (10) which is present in the receiving device (30) from the receiving device (30).

16. Method according to clause 15, which further comprises the following steps: —after the step of fixing the receiving device (30) in a position in which the receiving device central axis (35) is parallel to the central mast axis (15) of the first mast (10) in the mast construction position, and prior to the step of removing the mast section of the first mast (10) which is present in the receiving device (30) from the receiving device (30), releasing the locking of the mast section which is in the transfer position and moving this mast section from the transfer position into the receiving position in the receiving device (30), —then, still prior to the step of removing the mast section of the first mast (10) which is present in the receiving device (30) from the receiving device, locking the position of a subsequent mast section relative to the receiving device (30) in the transfer position.

The invention claimed is:

1. A Crane, which crane comprises:

a crane base;

a first mast having a central mast axis, wherein the first mast comprises a mast section, and the first mast is tiltable relative to the crane base around a first mast pivot axis within a range of angular positions, wherein the range of angular positions includes a mast construction position and an inclined mast operating position, wherein the first mast pivot axis extends perpendicular to the central mast axis;

a receiver adapted to receive the mast section of the first mast, wherein the receiver has a receiver central axis which is perpendicular to the first mast pivot axis and parallel to the central mast axis, and a mast section guide adapted to guide movement of the mast section relative to the receiver in the direction of the receiver central axis;

a mast section mover adapted to move the mast section of the first mast relative to the receiver in the direction of the receiver central axis from a receiving position into a transfer position;

a lock adapted to releasably lock the position of the mast section of the first mast relative to the receiver in the transfer position; and a first mast fixture adapted to releasably fix the first mast in the mast construction position, wherein the crane further comprises a second mast, which second mast has a central second mast axis, and is tiltable relative to the crane base around a second mast pivot axis which extends perpendicular to the central second mast axis, which second mast is also configured to be connected to a ballast, the crane is configured during a hoisting operation to move the ballast closer and further away from the crane base in a direction substantially parallel to a support surface on which the crane base is arranged as well as in a vertical direction to the support surface.

2. The Crane according to claim 1, wherein the first mast is a main boom, and wherein the second mast is a back mast.

3. The Crane according to claim 1, wherein the mast section mover is provided with one or more cables to bring the mast section from the receiving position to the transfer position.

4. The Crane according to claim 1, wherein the crane is a high-capacity crane.

5. The Crane according to claim 1, wherein an imaginary assembly space is defined as extending vertically upwards above the crane base and having outer borders in horizontal direction extending vertically upwards from outer borders of the crane base, wherein the first mast is configured to be completely within said imaginary assembly space when the first mast is in the mast construction position.

6. The Crane according to claim 5, wherein the receiver, the mast section mover, and the lock are configured to be completely within said imaginary assembly space when the first mast is in the mast construction position and during assembly of the first mast.

7. The Crane according to claim 1, wherein the receiver is connected to the crane base and tiltable along with the first mast relative to the crane base around the first mast pivot axis.

8. The Crane according to claim 1, wherein the first mast comprises a lower mast section which is connected to the crane base and tiltable relative to the crane base around the first mast pivot axis.

9. The Crane according to claim 1, wherein the central mast axis of the first mast extends vertically when the first mast is in the mast construction position.

10. The Crane according to claim 1, wherein a mast section of the first mast is provided with at least a part of a hoisting system.

11. The Crane according to claim 1, wherein the first mast comprises a tilting member which allows an upper portion of the first mast to tilt away from the central mast axis of the first mast.

12. A Method for assembling a crane according to claim 1, wherein the method comprises the following steps:

connecting the receiver which is adapted to receive a mast section of the first mast and which has the receiver central axis to the crane base, wherein the first mast pivot axis extends perpendicular to the receiver central axis;

fixing the receiver in a position in which the receiver central axis is parallel to the central mast axis of the first mast in the mast construction position;

arranging the mast section of the first mast of the crane in the receiver;

moving the mast section of the first mast relative to the receiver in the direction of the receiver central axis from the receiving position into the transfer position, wherein the mast section of the first mast is in the angular position which corresponds to the mast construction position of the first mast; and locking the position of the mast section relative to the receiver in the transfer position to build up the first mast.

13. The Method according to claim 12, wherein each of the mast section of the first mast remains within an imaginary assembly space, at least from the moment that said mast section is arranged in the receiver until the first mast is assembled in the mast construction position, wherein the imaginary assembly space is defined as extending vertically upwards above the crane base and having outer borders in horizontal direction extending vertically upwards from outer borders of the crane base.

14. The Method according to claim 12, further comprising the steps of releasing the fixing of the receiver and removing the receiver.

15. The Method according to claim 14, wherein the method comprises the following steps, after assembling the first mast and the removing of the receiver:

connecting the receiver to the crane base on a position where the second mast is to be assembled, said position being offset from the first mast, wherein the receiver is adapted to receive a mast section of the second mast;

fixing the receiver in a position in which the receiver central axis is parallel to the central mast axis of the second mast in the mast construction position;

arranging a mast section of the second mast of the crane in the receiver;

moving the mast section of the second mast relative to the receiver in the direction of the receiver central axis from a receiving position into a transfer position, wherein the mast section of the second mast is in an angular position which corresponds to the second mast construction position; and locking the position of the mast section relative to the receiver in the transfer position to build up the second mast.

16. The Method according to claim 14, wherein the method further comprises the following steps, after assembling the first mast and the removing of the receiver:

connecting the receiver to a further crane base, wherein the receiver is adapted to receive a mast section of a further first mast;

fixing the receiver in a position in which the receiver central axis is parallel to a central mast axis of the further first mast in the mast construction position;

arranging a mast section of the further first mast of the crane in the receiver;

moving the mast section of the further first mast relative to the receiver in the direction of the receiver central axis from a receiving position into a transfer position, wherein the mast section of the further first mast is in an angular position which corresponds to the mast construction position of the further first mast; and locking the position of the mast section relative to the receiver in the transfer position to build up the further first mast.

17. The Method according to claim 16, wherein the receiver is connected tiltably to the further crane base, therewith making the receiver tiltable relative to the further crane base around a further first mast pivot axis, which further first mast pivot axis extends perpendicular to the receiver central axis; and wherein the method comprises releasing the fixing of the receiver and tilting the further first mast, together with the receiver, around the further first mast pivot axis into an angular position which corresponds to the inclined mast operating position.

18. The Method according to claim 12, wherein the step of connecting the receiver to the crane base includes: tiltably connecting the receiver to the crane base, therewith making the receiver tiltable relative to the crane base around the first mast pivot axis, wherein the method further includes:

releasing the fixing of the receiver and tilting the receiver and the first mast together around the first mast pivot axis into an angular position which corresponds to the inclined mast operating position.

19. The Method according to claim 12, wherein the method further comprises the following steps:

after the step of locking the position of the mast section relative to the receiver in the transfer position and before the step of releasing the fixing of the receiver, arranging a further mast section of the first mast of the crane in the receiver;

connecting the further mast section of the first mast to the mast section of the first mast that is locked in the transfer position;

unlocking the mast section of the first mast in the transfer position;

moving the further mast section of the first mast relative to the receiver in the direction of the receiver central axis from a receiving position into the transfer position, wherein the mast section of the first mast is in an angular position which corresponds to the mast construction position of the first mast, and therewith moving the mast section which was in the transfer position away from the transfer position in a direction that is parallel to the central mast axis to further build up the first mast; and locking the position of the further mast section relative to the receiver in the transfer position.

20. The Method according to claim 12, wherein the method further comprises the following steps:

after the step of locking the position of the mast section relative to the receiver in the transfer position and before the step of releasing the fixing of the receiver: arranging a lower mast section of the first mast of the crane in the receiver;

connecting the lower mast section of the first mast to the mast section or further mast section of the first mast that is locked in the transfer position to further build up the first mast; and connecting the lower mast section of the first mast to the crane base and making the lower mast section of the first mast tiltable relative to the crane base around the first mast pivot axis.

21. The Method according to claim 12, wherein the mast section is an intermediate mast section, wherein the method further comprises a step of arranging a top mast sections on top of the intermediate section, or the highest intermediate section.

22. The Method according to claim 12, wherein at least one mast section of the first mast comprises at least a part of a hoisting system, which method further comprises the following steps:

connecting a hoisting cable which is connected to the at least part of the hoisting system of the mast section of the first mast to a mast section of the second mast; and connecting the mast section of the second mast to the crane base to build up the second mast and making the second mast tiltable relative to the crane base around a second mast pivot axis, which is parallel to the first mast pivot axis.

23. The Method according to claim 22, wherein the step of connecting a hoisting cable which is connected to the at least part of the hoisting system of the mast section of the first mast to a mast section of the second mast takes place before releasing the fixing of the receiver.

24. The Method according to claim 22, wherein the method further comprises the step of tilting the second mast into an inclined second mast operating position.

25. The Method according to claim 12, wherein in the step of fixing the receiver in a position in which the receiver central axis is parallel to the central mast axis of the first mast in the mast construction position, the receiver is fixed in a position in which the receiver central axis extends vertically.

26. The Method according to claim 12, wherein the method further comprises the step of tilting an upper portion of the first mast away from the central mast axis of the first mast.

27. A Method for disassembling a crane according to claim 1, which method comprises the following steps:

tilting the first mast, around the first mast pivot axis into an angular position which corresponds to the mast construction position;

fixing the receiver in a position in which the receiver central axis is parallel to the central mast axis of the first mast in the mast construction position; and removing a mast section of the first mast which is present in the receiver from the receiver.

28. The Method according to claim 27, which further comprises the following steps:

after the step of fixing the receiver in a position in which the receiver central axis is parallel to the central mast axis of the first mast in the mast construction position, and prior to the step of removing the mast section of the first mast which is present in the receiver from the receiver, releasing the locking of the mast section which is in the transfer position and moving this mast section from the transfer position into the receiving position in the receiver; and then, still prior to the step of removing the mast section of the first mast which is present in the receiver from the receiver, locking the position of a subsequent mast section relative to the receiver in the transfer position.

29. The Method according to claim 27, wherein the first mast is tilted together with the receiver, in the step of tilting the first mast around the first mast pivot axis into an angular position which corresponds to the mast construction position.

* * * * *